US010667375B2

(12) United States Patent
Yanagida

(10) Patent No.: US 10,667,375 B2
(45) Date of Patent: May 26, 2020

(54) EXTREME ULTRAVIOLET LIGHT GENERATION METHOD

(71) Applicant: Gigaphoton Inc., Tochigi (JP)

(72) Inventor: Tatsuya Yanagida, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 16/239,746

(22) Filed: Jan. 4, 2019

(65) Prior Publication Data

US 2019/0159327 A1 May 23, 2019

Related U.S. Application Data

(63) Continuation of application No. PCT/JP2017/026513, filed on Jul. 21, 2017.

(30) Foreign Application Priority Data

Aug. 8, 2016 (JP) ..... PCT/JP2016/073331

(51) Int. Cl.
*H05G 2/00* (2006.01)

(52) U.S. Cl.
CPC ..... *H05G 2/006* (2013.01); *H05G 2/00* (2013.01); *H05G 2/005* (2013.01); *H05G 2/008* (2013.01)

(58) Field of Classification Search
CPC ..... H05G 2/003; H05G 2/008
See application file for complete search history.

(56) References Cited

U.S. PATENT DOCUMENTS 5,991,360 A 11/1999 Matsui et al.
8,791,440 B1 * 7/2014 Tao ..... H01S 3/10 250/504 R
2005/0258768 A1 * 11/2005 Gaebel ..... H05G 2/003 315/111.81
2011/0101863 A1 5/2011 Komori et al.
(Continued)

FOREIGN PATENT DOCUMENTS

JP H10-221499 A 8/1998
JP 2013-175724 A 9/2013
(Continued)

OTHER PUBLICATIONS

International Search Report issued in PCT/JP2017/026513; dated Sep. 26, 2017.
(Continued)

*Primary Examiner* — Eliza W Osenbaugh-Stewart
(74) *Attorney, Agent, or Firm* — Studebaker & Brackett PC

(57) ABSTRACT

An extreme ultraviolet light generation method according to one aspect of the present disclosure includes outputting a droplet to a first laser light irradiation region that is a region different from a plasma generation region, irradiating the droplet that reaches the first laser light irradiation region with first laser light to generate a deformed liquid target, irradiating the deformed liquid target that reaches a second laser light irradiation region that is a region different from the plasma generation region with second laser light to generate a fragment jet target, and irradiating at least a part of the fragment jet target that reaches the plasma generation region with third laser light that propagates in a direction intersecting a propagation direction of the second laser light.

18 Claims, 15 Drawing Sheets

(56) References Cited

U.S. PATENT DOCUMENTS

| | | | | |
|---|---|---|---|---|
| 2013/0207004 | A1 | 8/2013 | Ceglio et al. | |
| 2013/0320232 | A1 | 12/2013 | Hori et al. | |
| 2014/0084183 | A1* | 3/2014 | Wakabayashi ..... | H05G 2/008 250/492.1 |
| 2014/0264087 | A1* | 9/2014 | Rafac ..... | H05G 2/005 250/504 R |
| 2015/0083939 | A1 | 3/2015 | Ueno et al. | |
| 2017/0127505 | A1 | 5/2017 | Sunahara et al. | |

FOREIGN PATENT DOCUMENTS

| | | | |
|---|---|---|---|
| JP | 2013-251100 | A | 12/2013 |
| JP | 5454881 | B2 | 3/2014 |
| JP | 2015-532505 | A | 11/2015 |
| JP | 2015-536545 | A | 12/2015 |
| JP | 2016-518674 | A | 6/2016 |
| WO | 2013/180007 | A1 | 12/2013 |
| WO | 2014/051891 | A1 | 4/2014 |
| WO | 2014/072149 | A2 | 5/2014 |
| WO | 2014/143522 | A1 | 9/2014 |
| WO | 2016/027346 | A1 | 2/2016 |

OTHER PUBLICATIONS

The International Preliminary Report on Patentability and Written Opinion of the International Searching Authority; PCT/JP20171026513; dated Feb. 12, 2019.

* cited by examiner

-Related Art-

EXTREME ULTRAVIOLET LIGHT GENERATION METHOD

CROSS-REFERENCE TO RELATED APPLICATIONS

The present application is a continuation application of International Application No. PCT/JP 2017/026513 filed on Jul. 21, 2017 claiming the priority to International Application No. PCT/JP2016/073331 filed on Aug. 8, 2016. Each of the above applications is incorporated herein by reference in its entirety.

BACKGROUND

1. Technical Field

The present disclosure relates to an extreme ultraviolet light generation method.

2. Related Art

In recent years, along with microfabrication in the semiconductor manufacturing process, fine transfer patterns in photolithography of the semiconductor manufacturing process are developed rapidly. In the next generation, microfabrication of 20 nm or smaller will be required. Accordingly, it is expected to develop an exposure device in which a device for generating extreme ultraviolet (EUV) light having a wavelength of about 13 nm and a reflection reduction projection optical system are combined.

As EUV light generation devices, three types of devices are proposed, namely, a laser produced plasma (LPP) type device that uses plasma generated when a target material is irradiated with laser light, a discharge produced plasma (DPP) type device that uses plasma generated by discharging, and a synchrotron radiation (SR) type device that uses orbital radiation light.

CITATION LIST

Patent Literature

Patent Literature 1: Published Japanese Translations of PCT International Publication for Patent Application No. 2015-536545

Patent Literature 2: Japanese Patent No. 5454881

Patent Literature 3: Japanese Patent Application Laid-Open No. 2013-175724

Patent Literature 4: Japanese Patent Application Laid-Open No. 10-221499

Patent Literature 5: International Publication No. WO 2013/180007

Patent Literature 6: International Publication No. WO 2016/027346

SUMMARY

An extreme ultraviolet light generation method according to one aspect of the present disclosure may include a droplet output step of outputting a droplet to a first laser light irradiation region that is a region different from a plasma generation region, a deformed liquid target generation step of irradiating the droplet with first laser light to generate a deformed liquid target, the droplet being output in the droplet output step and reaching the first laser light irradiation region, a fragment jet target generation step of irradiating the deformed liquid target with second laser light to generate a fragment jet target, the deformed liquid target being generated in the deformed liquid target generation step and reaching a second laser light irradiation region that is a region different from the plasma generation region, and a third laser light irradiation step of irradiating at least a part of the fragment jet target with third laser light that propagates in a direction intersecting a propagation direction of the second laser light, the fragment jet target being generated in the fragment jet target generation step and reaching the plasma generation region.

BRIEF DESCRIPTION OF THE DRAWINGS

Some embodiments of the present disclosure will be described below as just examples with reference to the accompanying drawings.

EMBODIMENTS

Contents

Figure 1:
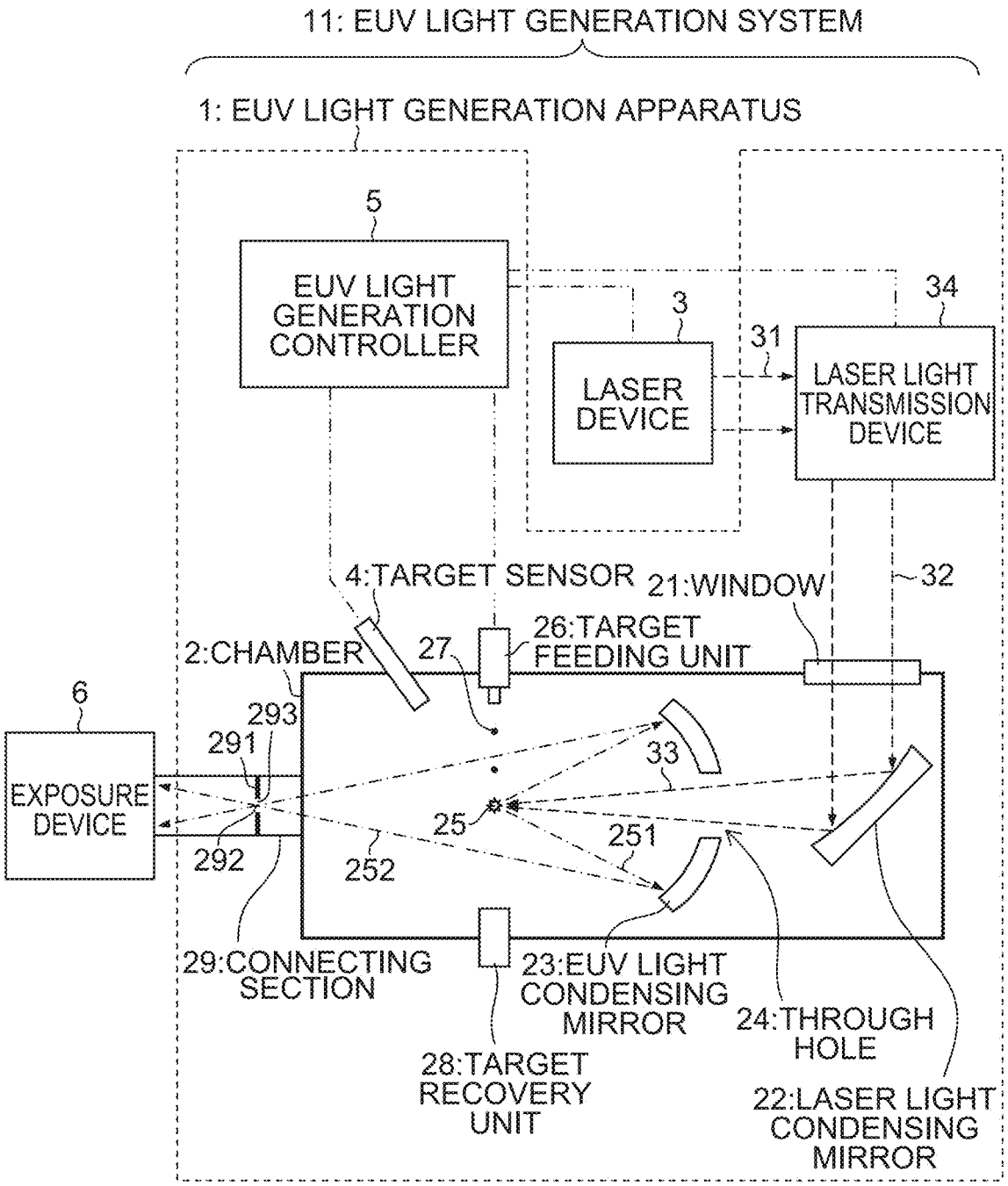
FIG. 1 is a diagram schematically illustrating a configuration of an exemplary LPP type EUV light generation system.

1. Overall description of extreme ultraviolet light generation system 1.1 Configuration
1.2 Operation
2. Description of EUV light generation system in which target is irradiated with first laser light, second laser light, and third laser light
2.1 Configuration
2.2 Operation
3. Terms
4. Problem
5. First Embodiment
5.1 Configuration
5.2 Operation
5.3 State change in target substance
5.4 Main pulse laser light
5.5 Effect
6. Second Embodiment
6.1 Configuration
6.2 Operation
6.3 Debris suppression device
6.4 Effect
7. Third Embodiment
7.1 Configuration
7.2 Operation
7.3 Effect
7.4 Modification
8. Fourth Embodiment
8.1 Configuration
8.2 Operation
8.3 Effect
9. Fifth Embodiment
9.1 Configuration
9.2 Operation
9.3 Effect Hereinafter, embodiments of the present disclosure will be described in detail with reference to the drawings.

The embodiments described below illustrate some examples of the present disclosure, and do not limit the contents of the present disclosure. All of the configurations and the operations described in the embodiments are not always indispensable as configurations and operations of the present disclosure. The same constituent elements are denoted by the same reference signs, and overlapping description is omitted.

1. Overall Description of Extreme Ultraviolet Light Generation System

1.1 Configuration

FIG. 1 schematically illustrates a configuration of an exemplary LPP type EUV light generation system. An EUV light generation apparatus 1 may be used together with at least one laser device 3. In the present disclosure, a system including the EUV light generation apparatus 1 and a laser device 3 is referred to as an EUV light generation system 11. As illustrated in FIG. 1 and described below in detail, the EUV light generation apparatus 1 includes a chamber 2 and a target feeding unit 26. The chamber 2 is a sealable container. The target feeding unit 26 feeds a target substance to the inside of the chamber 2, and is mounted so as to penetrate a wall of the chamber 2, for example. The material of the target substance output from the target feeding unit 26 may include, but not limited to, tin, terbium, gadolinium, lithium, xenon, or a combination of any two or more of them.

A wall of the chamber 2 has at least one through hole. The through hole is closed with a window 21 which transmits pulse laser light 32 output from the laser device 3. In the chamber 2, an EUV light condensing mirror 23 having a spheroidal reflection surface is disposed, for example. The EUV light condensing mirror 23 has a first focus and a second focus. On the surface of the EUV light condensing mirror 23, a multilayer reflection film in which molybdenum and silicon are alternately layered is formed, for example. The EUV light condensing mirror 23 may be disposed such that the first focus thereof is positioned in a plasma generation region 25 and the second focus thereof is positioned at an intermediate focusing point (IF) 292, for example. A center portion of the EUV light condensing mirror 23 has a through hole 24 through which pulse laser light 33 passes.

The EUV light generation apparatus 1 includes an EUV light generation controller 5, a target sensor 4, and the like. The target sensor 4 detects one of, or a plurality of, presence, trajectory, position, and velocity of the target 27. The target sensor 4 may have an imaging function.

The EUV light generation apparatus 1 also includes a connecting section 29 that allows the inside of the chamber 2 and the inside of an exposure device 6 to communicate with each other. The inside of the connecting section 29 is provided with a wall 291 having an aperture 293. The wall 291 may be disposed such that the aperture 293 is positioned at the second focus position of the EUV light condensing mirror 23.

The EUV light generation apparatus 1 also includes a laser light transmission device 34, a laser light condensing mirror 22, a target recovery unit 28 for recovering the target 27, and the like. The laser light transmission device 34 includes an optical element for defining a transmission state of the laser light, and an actuator for regulating the position, posture, and the like of the optical element.

1.2 Operation

Operation of the exemplary LPP type EUV light generation system will be described with reference to FIG. 1. The pulse laser light 31 output from the laser device 3 passes through the window 21 as pulse laser light 32 via the laser light transmission device 34, and enters the chamber 2. The pulse laser light 32 travels inside the chamber 2 along at least one laser light path, is reflected by the laser light condensing mirror 22, and is radiated to at least one target 27 as pulse laser light 33.

The target feeding unit 26 may output a target 27 made of a target substance toward a plasma generation region 25 in the chamber 2. The target 27 is irradiated with at least one pulse included in the pulse laser light 33. The target 27 irradiated with the pulse laser light is made into plasma, and radiation light 251 is emitted from the plasma. EUV light 252 included in the radiation light 251 is selectively reflected by the EUV light condensing mirror 23. The EUV light 252 reflected by the EUV light condensing mirror 23 is condensed at the intermediate focusing point 292 and is output to the exposure device 6. One target 27 may be irradiated with a plurality of pulses included in the pulse laser light 33.

The EUV light generation controller 5 presides over the control of the entire EUV light generation system 11. The EUV light generation controller 5 processes a detection result of the target sensor 4. The EUV light generation controller 5 may control, for example, oscillation timing of the laser device 3, radiation direction of the pulse laser light 32, and condensing position of the pulse laser light 33, and the like, based on the detection result of the target sensor 4. The aforementioned various types of control are mere examples. Other types of control may be added as required.

2. Description of EUV Light Generation System in which Target is Irradiated with First Laser Light, Second Laser Light, and Third Laser Light

2.1 Configuration

Figure 2:
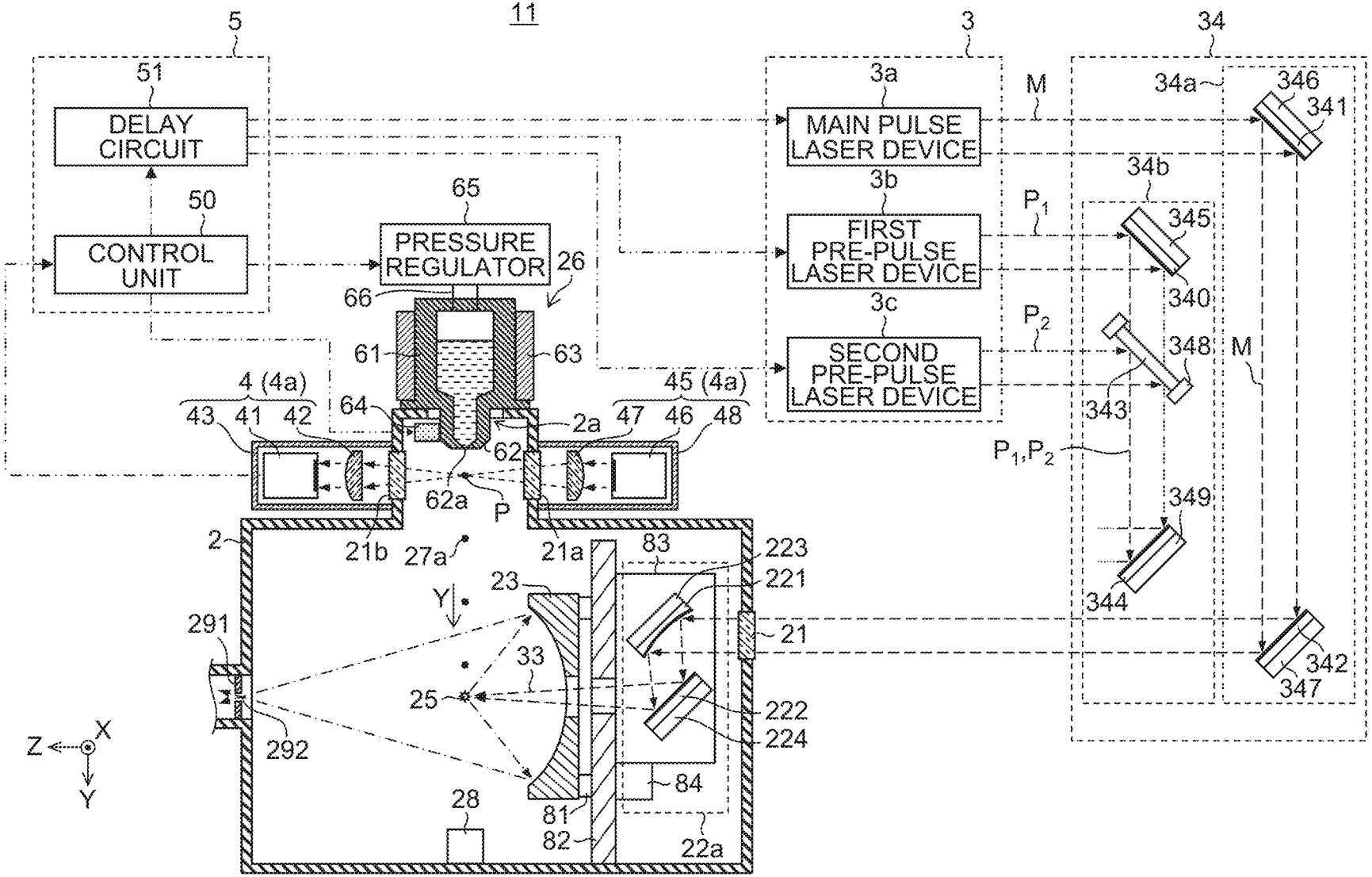
FIG. 2 is a partial cross-sectional view illustrating a configuration of an EUV light generation system applicable to an embodiment of the present disclosure.

FIG. 2 is a partial cross-sectional view illustrating a configuration of an EUV light generation system applicable to an embodiment of the present disclosure. Respective constituent elements of the EUV light generation system 11 in the present disclosure are adoptable in respective steps of an extreme ultraviolet light generation method.

In the present disclosure, regarding the X direction, a direction from the rear surface to the front surface penetrating the sheet of FIG. 2 is assumed to be a plus direction. Regarding the Y direction, a direction from the target feeding unit 26 toward the target recovery unit 28 in FIG. 2 is assumed to be a plus direction. Regarding the Z direction, a direction from the EUV light condensing mirror 23 toward the intermediate focusing point 292 in FIG. 2 is assumed to be a plus direction.

The EUV light generation system 11 includes the chamber 2, the laser device 3, the target sensor 4, the EUV light generation controller 5, the target feeding unit 26, and the laser light transmission device 34.

Figure 3:
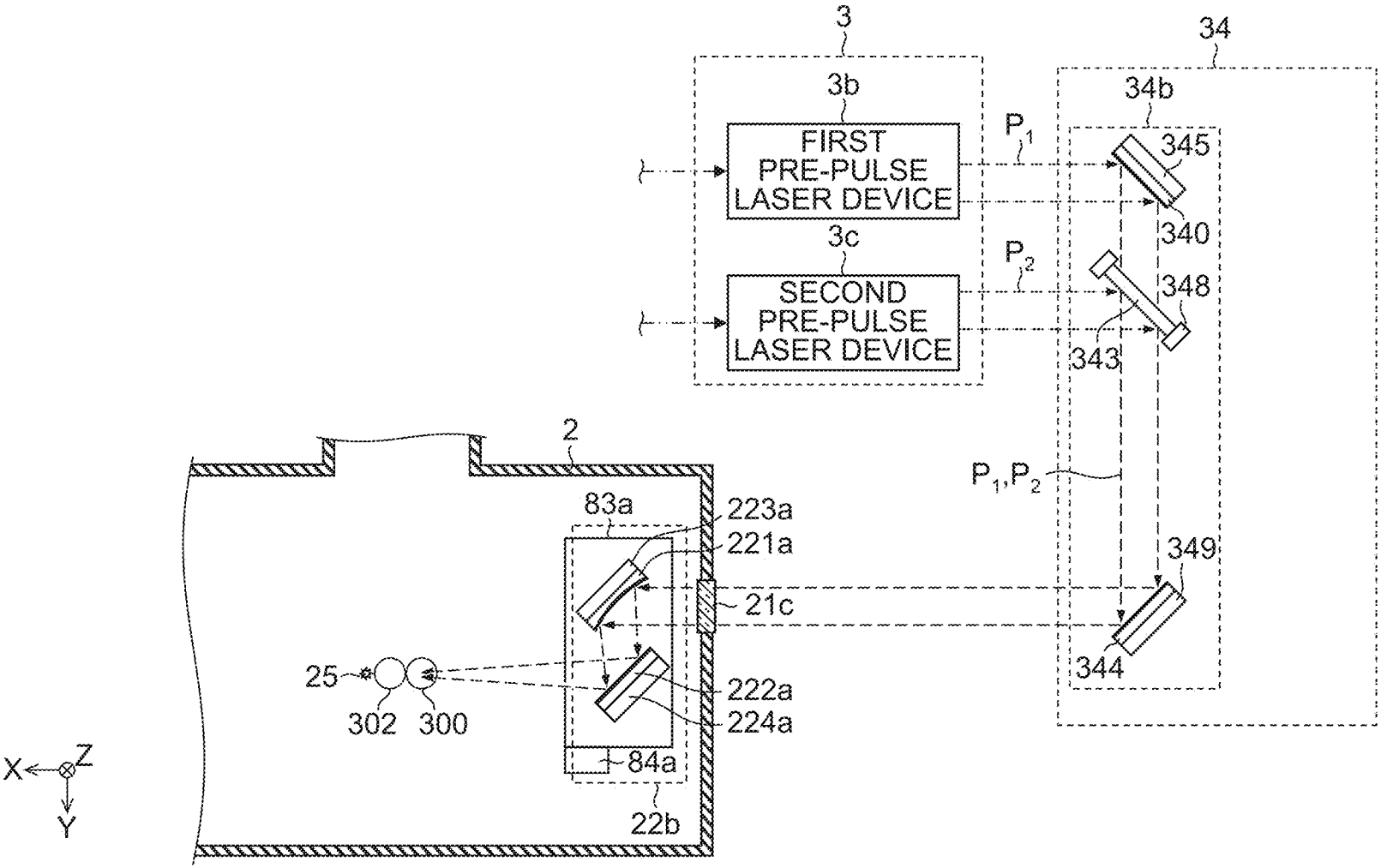
FIG. 3 is a partial cross-sectional view illustrating a configuration of a light condensing optical system for first pre-pulse laser light and second pre-pulse laser light.

The chamber 2 includes therein the window 21, a window 21*b* at the boundary with the target sensor 4, and a window 21*a* at the boundary with a light emission unit 45. The chamber 2 also includes therein a first laser light condensing optical system 22*a*, the EUV light condensing mirror 23, an EUV light condensing mirror holder 81, an EUV light condensing mirror holder holding plate 82, and the target recovery unit 28. The chamber 2 also includes therein a second laser light condensing optical system 22*b* not illustrated in FIG. 2. The second laser light condensing optical system 22*b* is not illustrated in FIG. 2 but is illustrated in FIG. 3.

The first laser light condensing optical system 22*a* includes a first high-reflective off-axis paraboloid mirror 221, a first high-reflective planar mirror 222, the first laser light condensing optical system holding plate 83, and a first stage 84 movable in the X direction, the Y direction, and the Z direction. The first laser light condensing optical system 22*a* is disposed such that the light condensing position of the first laser light condensing optical system 22*a* agrees with the plasma generation region 25. "Agree" may include "substantially agree" where it can be deemed that they agree with each other, although they are strictly different from each other.

The first high-reflective off-axis paraboloid mirror 221 is supported by a sixth mirror holder 223. The first high-reflective planar mirror 222 is supported by a seventh holder 224. The target recovery unit 28 is disposed on an extended line of the trajectory of a droplet 27*a*. The target recovery unit 28 recovers a target substance that passed through a first pulse laser irradiation region.

The chamber 2 includes the target feeding unit 26 and a droplet detection device 4*a*. The target feeding unit 26 includes a tank 61, a nozzle 62, a heater 63, a piezoelectric element 64, and a pressure regulator 65.

The tank 61 is formed in a hollow cylindrical shape. The tank 61 contains a target substance inside thereof. The tank 61 has a heater 63. The heater 63 is fixed to a cylindrical outer side face. The heater 63 heats the tank 61.

The nozzle 62 has a nozzle hole 62*a* for outputting a target substance. The nozzle 62 has a piezoelectric element 64. The piezoelectric element 64 is connected with a control unit 50. The nozzle 62 is provided to the bottom face of the cylindrical tank 61. The nozzle 62 is provided inside the chamber 2 through the target feeding hole 2*a* of the chamber 2. The target feeding hole 2*a* of the chamber 2 is closed when the target feeding unit 26 is disposed.

One end of the nozzle 62 in a pipe shape is fixed to the hollow tank 61. The other end of the nozzle 62 in a pipe shape has the nozzle hole 62*a*. The nozzle hole 62*a* is provided inside the chamber 2. On an extended line in a center axis direction of the nozzle 62, an irradiation region in which the droplet 27*a* is irradiated with first pre-pulse laser light $P_1$ is located. In FIG. 2, the irradiation region of the first pre-pulse laser light $P_1$ is not illustrated. The irradiation region of the first pre-pulse laser light $P_1$ is denoted by a reference numeral 300 in FIG. 3. Hereinafter, the irradiation region of the first pre-pulse laser light $P_1$ is referred to as a first pre-pulse laser light irradiation region 300.

The droplet detection device 4*a* includes the target sensor 4 and a light emission unit 45. The droplet detection device 4*a* is disposed at a position where passage of the droplet 27*a* is detected at the detection position P before the droplet 27*a* reaches the target generation region. The droplet detection device 4*a* outputs a passage timing signal representing timing that the droplet 27*a* passes through the detection position P.

The target sensor 4 and the light emission unit 45 are arranged opposite to each other over the trajectory of the droplet 27*a*. The target sensor 4 includes an optical sensor 41, a sensor light condensing optical system 42, and a sensor container 43. The sensor container 43 is provided outside the chamber 2. The optical sensor 41 and the sensor light condensing optical system 42 are disposed inside the sensor container 43. The light emission unit 45 includes a light source 46, a light source condensing optical system 47, and a light source container 48. The light source container 48 is provided outside the chamber 2. The light source 46 and the light source condensing optical system 47 are disposed inside the light source container 48.

The pressure regulator 65 communicates with the target feeding unit 26 including the tank 61 via the pipe 66. The pressure regulator 65 supplies gas into the tank 61 to thereby apply pressure to the tank 61. The pressure regulator 65 discharges gas from the inside of the tank 61 to thereby reduce the pressure of the tank 61. As the gas, inert gas may be adoptable.

The EUV light generation system 11 has the laser device 3, the EUV light generation controller 5, and the laser light transmission device 34, outside the chamber 2. The laser device 3 includes a main pulse laser device 3*a*, a first pre-pulse laser device 3*b*, and a second pre-pulse laser device 3*c*. The polarization direction of the first pre-pulse laser light $P_1$ and the polarization direction of the second pre-pulse laser light $P_2$ are orthogonal to each other, and are made incident on a polarizer 343 described below. For example, it is configured that the first pre-pulse laser light $P_1$ is made incident as P polarized light and the second pre-pulse laser light $P_2$ is made incident as S polarized light, on the polarizer 343.

The main pulse laser device 3*a* may be a $CO_2$ laser device. Each of the first pre-pulse laser device 3*b* and the second pre-pulse laser device 3*c* may be a YAG (Yttrium Aluminum Garnet) laser device. Each of the first pre-pulse laser device 3*b* and the second pre-pulse laser device 3*c* may be a laser device using Nd:$YVO_4$. A YAG laser device includes a laser oscillator and, if required, a laser amplifier, and YAG crystal is used as a laser medium in at least one of the laser oscillator and the laser amplifier. A $CO_2$ laser device includes a laser oscillator and, if required, a laser amplifier, and $CO_2$ gas is used as a laser medium in at least one of the laser oscillator and the laser amplifier.

The first pre-pulse laser device 3*b* outputs the first pre-pulse laser light $P_1$. First laser light corresponds to the first pre-pulse laser light $P_1$ in the present disclosure. The second pre-pulse laser device 3*c* outputs the second pre-pulse laser light $P_2$. Second laser light corresponds to the second pre-pulse laser light $P_2$ in the present disclosure. The main pulse laser device 3*a* outputs main pulse laser light M. Third laser light corresponds to the main pulse laser light M in the present disclosure.

The EUV light generation controller 5 includes a control unit 50 and a delay circuit 51. The control unit 50 outputs data for setting delay periods of the main pulse laser light M, the first pre-pulse laser light $P_1$, and the second pre-pulse laser light $P_2$. The data for setting the delay periods of the main pulse laser light M, the first pre-pulse laser light $P_1$, and the second pre-pulse laser light $P_2$ is input to the delay circuit 51. An output from the droplet detection device 4*a* is input to the delay circuit 51 via the control unit 50. An output from the delay circuit 51 is input as a light emission trigger to the main pulse laser device 3*a*, the first pre-pulse laser device 3*b*, and the second pre-pulse laser device 3*c*.

The laser light transmission device 34 includes a main pulse laser light transmission device 34*a* and the pre-pulse laser light transmission device 34*b*. The main pulse laser light transmission device 34*a* includes a first high-reflective mirror 341 and a second high-reflective mirror 342. The first high-reflective mirror 341 is supported by a first holder 346. The second high-reflective mirror 342 is supported by a second holder 347. The first high-reflective mirror 341 and the second high-reflective mirror 342 are disposed such that the main pulse laser light M is made incident on the first laser light condensing optical system 22*a*.

The pre-pulse laser light transmission device 34*b* includes a third high-reflective mirror 340, a polarizer 343, and a fourth high-reflective mirror 344. The third high-reflective mirror 340 is supported by a third holder 345. The polarizer 343 is supported by a fourth holder 348. The fourth high-reflective mirror 344 is supported by a fifth holder 349.

The polarizer 343 may be a beam splitter coated with a film that transmits the P polarized light at a high rate and reflects the S polarized light at a high rate. In FIG. 3, the polarizer 343 may be disposed such that an incidence surface and an XY plane agree with each other. The polarizer 343 may be disposed at a position where the optical axis of the first pre-pulse laser light $P_1$ and the optical axis of the second pre-pulse laser light $P_2$ agree with each other. The third high-reflective mirror 340, the polarizer 343, and the fourth high-reflective mirror 344 are disposed such that the first pre-pulse laser light $P_1$ and the second pre-pulse laser light $P_2$ are made incident on the second laser light condensing optical system 22*b* not illustrated in FIG. 2.

In FIG. 2, the first pre-pulse laser light $P_1$ and the second pre-pulse laser light $P_2$, reflected by the fourth high-reflective mirror 344, are not illustrated. The first pre-pulse laser light $P_1$ and the second pre-pulse laser light $P_2$, reflected by the fourth high-reflective mirror 344, propagate along the plus X direction in FIG. 3.

The first pre-pulse laser light $P_1$ and the second pre-pulse laser light $P_2$, reflected by the fourth high-reflective mirror 344, are introduced to the chamber 2 via a window for introducing the first pre-pulse laser light $P_1$ and the second pre-pulse laser light $P_2$. In FIG. 2, a window for introducing the first pre-pulse laser light $P_1$ and the second pre-pulse laser light $P_2$ is not illustrated. A window for introducing the first pre-pulse laser light $P_1$ and the second pre-pulse laser light $P_2$ is denoted by a reference numeral 21*c* in FIG. 3.

FIG. 3 is a partial cross-sectional view illustrating configurations of a light condensing optical system of the first pre-pulse laser light $P_1$ and a light condensing optical system of the second pre-pulse laser light $P_2$. In FIG. 3, an XY plane is illustrated. In the chamber 2, the window 21*c* for introducing the first pre-pulse laser light $P_1$ and the second pre-pulse laser light $P_2$, and a second laser light condensing optical system 22*b* are provided.

The second laser light condensing optical system 22*b* includes a second high-reflective off-axis paraboloid mirror 221*a*, a second high-reflective planar mirror 222*a*, a second laser light condensing optical system holding plate 83*a*, and a second stage 84*a* movable in the X direction, the Y direction, and the Z direction. The second high-reflective off-axis paraboloid mirror 221*a* is supported by an eighth holder 223*a*. The second high-reflective planar mirror 222*a* is supported by a ninth holder 224*a*. The second laser light condensing optical system 22*b* is disposed such that the light condensing position of the second laser light condensing optical system 22*b* agrees with the first pre-pulse laser light irradiation region 300. Further, the second laser light condensing optical system 22*b* is disposed such that the light condensing position of the second laser light condensing optical system 22*b* agrees with the second pre-pulse laser light irradiation region 302.

The first pre-pulse laser light irradiation region 300 and the second pre-pulse laser light irradiation region 302 may partially overlap each other. A fragment jet target generation step may include an aspect of irradiating a deformed liquid target that reached the second pre-pulse laser light irradiation region 302 in which at least a part thereof overlaps the first pre-pulse laser light irradiation region 300, with the second pre-pulse laser light $P_2$, in the present disclosure.

The second laser light condensing optical system 22*b* is disposed such that the propagation direction of the first pre-pulse laser light $P_1$ and the propagation direction of the second pre-pulse laser light $P_2$ are orthogonal to the travel direction of the droplet 27*a*. The propagation direction of the first pre-pulse laser light $P_1$ and the propagation direction of the second pre-pulse laser light $P_2$ may intersect the travel direction of the droplet 27*a* at an angle equal to or smaller than 90°, or an angle larger than 90°.

In the present disclosure, an aspect in which the propagation direction of the first pre-pulse laser light $P_1$ and the propagation direction of the second pre-pulse laser light $P_2$ agree with each other is disclosed. In the present disclosure, the propagation direction of the first pre-pulse laser light $P_1$ may be replaced with the propagation direction of the second pre-pulse laser light $P_2$.

2.2 Operation

The EUV light generation controller 5 illustrated in FIG. 2 is configured such that when the EUV light generation controller 5 receives a signal representing generation of EUV light from the exposure device 6 illustrated in FIG. 1, the EUV light generation controller 5 transmits a droplet generation signal representing generation of the droplet 27*a*, to the control unit 50 illustrated in FIG. 2.

When the control unit 50 receives the droplet generation signal, the control unit 50 operates the heater 63 to heat the target substance up to a temperature equal to or higher than the melting point of the target substance to thereby melt the target substance. In the case where the target substance is tin, the melting point is 232° C.

When the control unit 50 receives a droplet generation signal, the control unit 50 transmits, to the pressure regulator 65, a control signal to operate the pressure regulator 65 such that the pressure applied to the target substance in the tank 61 becomes a predetermined pressure. When a predetermined pressure is applied to the target substance in the tank 61, the target substance is output from the nozzle 62 at a predetermined velocity.

The control unit 50 transmits, to a piezoelectric element 64, an electric signal to operate the piezoelectric element 64 such that the droplet 27*a* is generated at a predetermined frequency. The electric signal transmitted to the piezoelectric element 64 has a predetermined waveform. Consequently, the droplet 27*a* is generated at a predetermined frequency.

The droplet detection device 4*a* outputs a passage timing signal representing timing that the droplet 27*a* passes through the detection position P. The delay circuit 51 receives a passage timing signal output from the droplet detection device 4*a* via the control unit 50.

The control unit 50 transmits, to the delay circuit 51, target delay period data of the first pre-pulse laser device 3*b*, target delay period data of the second pre-pulse laser device 3*c*, and target delay period data of the main pulse laser device 3*a*, in advance. In the present disclosure, the target delay period of the first pre-pulse laser device 3*b* is assumed to be a first delay period. The target delay period of the second pre-pulse laser device 3*c* is assumed to be a second delay period. The target delay period of the main pulse laser device 3*a* is assumed to be a third delay period.

The first delay period is set such that after the droplet 27*a* passes through the detection position P, the droplet 27*a* is irradiated with the first pre-pulse laser light $P_1$ in the first pre-pulse laser light irradiation region 300. The first delay period is a period calculated by subtracting, from a period from the timing when the droplet 27*a* passes through the detection position P until the timing when the droplet 27*a* reaches the first pre-pulse laser light irradiation region 300, a period from the time when a first trigger signal described below is output to the first pre-pulse laser device 3 until when the first pre-pulse laser light $P_1$ reaches the first pre-pulse laser light irradiation region 300. When the droplet 27*a* is irradiated with the first pre-pulse laser light $P_1$, a deformed liquid target is generated. A deformed liquid target is denoted by a reference sign 27*b* in FIG. 6.

The second delay period is set such that after the droplet 27*a* is irradiated with the first pre-pulse laser light $P_1$, the deformed liquid target is irradiated with the second pre-pulse laser light $P_2$ in the second pre-pulse laser light irradiation region 302. The second delay period is a period calculated by subtracting, from a period from the timing when the droplet 27*a* passes through the detection position P until the timing when the deformed liquid target reaches the second pre-pulse laser light irradiation region 302, a period from the time when a second trigger signal described below is output to the second pre-pulse laser device 3*c* until when the second pre-pulse laser light $P_2$ reaches the second pre-pulse laser light irradiation region 302. When the deformed target is irradiated with the second pre-pulse laser light $P_2$, a fragment jet target is generated. The fragment jet target is denoted by a reference sign 27*f* in FIGS. 5 and 6.

The third delay period is set such that after the deformed liquid target is irradiated with the second pre-pulse laser light $P_2$, the fragment jet target is irradiated with the main pulse laser light M in the plasma generation region 25. The third delay period is a period calculated by subtracting, from a period from the timing when the droplet 27*a* passes through the detection position P until the timing when a part of the fragment jet target reaches the plasma generation region 25, a period from the time when a third trigger signal described below is output to the main pulse laser light transmission device 34*a* until when the main pulse laser light M reaches the plasma generation region 25.

A set value from the control unit 50 to the first pre-pulse laser device 3*b* may be energy per pulse of the first pre-pulse laser light $P_1$ or a pulse width of the first pre-pulse laser light $P_1$. A set value from the control unit 50 to the second pre-pulse laser device 3*c* may be energy per pulse of the second pre-pulse laser light $P_2$ or a pulse width of the second pre-pulse laser light $P_2$. A set value from the control unit 50 to the main pulse laser device 3*a* may be energy per pulse of the main pulse laser light M or a pulse waveform of the main pulse laser light M.

The delay circuit 51 transmits, to the first pre-pulse laser device 3*b*, a first trigger signal representing that the first delay period has passed from the receiving timing of the light emission trigger signal. The first pre-pulse laser device 3*b* outputs the first pre-pulse laser light $P_1$ according to the first trigger signal.

The delay circuit 51 transmits, to the second pre-pulse laser device 3*c*, a second trigger signal representing that the second delay period has passed from the receiving timing of the light emission trigger signal. The second delay period is a period exceeding the first delay period. The second pre-pulse laser device 3*c* outputs the second pre-pulse laser light $P_2$ according to the second trigger signal.

The first pre-pulse laser light $P_1$ is made incident on the third high-reflective mirror 340 as P polarized light. The first pre-pulse laser light $P_1$ is reflected by the third high-reflective mirror 340 at a high reflectance, and is made incident on the polarizer 343. The polarizer 343 transmits the first pre-pulse laser light $P_1$ at a high transmittance.

The second pre-pulse laser light $P_2$ is made incident on the polarizer 343 as S polarized light. The second pre-pulse laser light $P_2$ is reflected by the polarizer 343 at a high reflectance. The optical axis of the second pre-pulse laser light $P_2$ reflected by the polarizer 343 agrees with the optical axis of the first pre-pulse laser light $P_1$.

The first pre-pulse laser light $P_1$ and the second pre-pulse laser light $P_2$ are reflected by the fourth high-reflective mirror 344 at a high reflectance, and are made incident on the second laser light condensing optical system 22*b*. Each of the first pre-pulse laser light $P_1$ and the second pre-pulse laser light $P_2$, made incident on the second laser light condensing optical system 22*b*, is condensed to have a predetermined condensing diameter.

The first pre-pulse laser light $P_1$ condensed to have a predetermined condensing diameter is radiated to the droplet 27*a*. When the droplet 27*a* is irradiated with the first pre-pulse laser light $P_1$, a deformed liquid target is generated. The second pre-pulse laser light $P_2$ condensed to have a predetermined condensing diameter is radiated to the deformed liquid target. When the deformed liquid target is irradiated with the second pre-pulse laser light $P_2$, a fragment jet target is generated.

The delay circuit 51 transmits, to the main pulse laser device 3*a*, a third trigger signal representing that a third delay period has passed from the receiving timing of the light emission trigger signal. The third delay period is a period exceeding the second delay period. The main pulse laser device 3*a* outputs the main pulse laser light M according to the third trigger signal.

The main pulse laser light M is reflected by the first high-reflective mirror 341 and the second high-reflective mirror 342 at a high reflectance, and is made incident on the first laser light condensing optical system 22*a* via the window 21. The main pulse laser light M made incident on the first laser light condensing optical system 22*a* is condensed to have a predetermined condensing diameter.

The main pulse laser light M condensed to have a predetermined condensing diameter is radiated to the fragment jet target. When the fragment jet target is irradiated with the main pulse laser light M, at least a part of the fragment jet target is made into plasma, and EUV light is emitted from the target substance that was made into plasma.

3. Terms

"Target" is an object to be irradiated with laser light introduced to the chamber.

"Droplet" is a form of a target substance output to the inside of the chamber.

"Deformed liquid target" is a form of the target substance in which a droplet is deformed to have a thick disk shape. The deformed liquid target may be a droplet irradiated with pulse laser light and have a thick disk shape in which the center thereof is recessed.

"Disk-shaped dispersed target" is a form of the target substance in which the deformed liquid target is broken into pieces and a plurality of minute droplets are dispersed in a disk shape in a direction orthogonal to the propagation direction of the pre-pulse laser light.

"Tertiary target" is a form of the target substance in which minute droplets constituting the disk-shaped dispersed target are broken into pieces and a plurality of minute droplets are dispersed in a dome shape.

"Fragment jet target" is a form of the target substance in which the deformed liquid target is broken into pieces and a plurality of fine particles are dispersed along the propagation direction of the pre-pulse laser light.

"Debris component" is an unnecessary particle not contributing to radiation of EUV light, such as a fragment of the target substance existing inside the chamber.

"Travel direction of a fragment jet target" is a direction that particles of the target substance constituting the fragment jet target travel integrally.

"Upstream side of the travel direction of a fragment jet target" is a side of the second pre-pulse laser light irradiation region on the path of the fragment jet target.

"Downstream side of the travel direction of a fragment jet target" is a side opposite to the second pre-pulse laser light irradiation region on the path of the fragment jet target.

"Condensing diameter" is a diameter of a cross section orthogonal to the optical axis of the pulse laser light, of the optical path of the pulse laser light at radiation position to the target. "Condensing diameter" does not necessarily mean a minimum condensing diameter at a focus of a light condensing optical system.

"Propagation direction of laser light" is a direction from the light source to a target along the optical path. In the case where an optical element is disposed on an optical path and the orientation of the optical path is changeable, "propagation direction of laser light" is a direction from an optical element on the light source side toward an optical element on the target side.

"Upstream side in the propagation direction of pulse laser light" is a side of the light source on the optical path.

"Downstream side in the propagation direction of pulse laser light" is a side opposite to the light source on the optical path.

4. Problem

Figure 4:
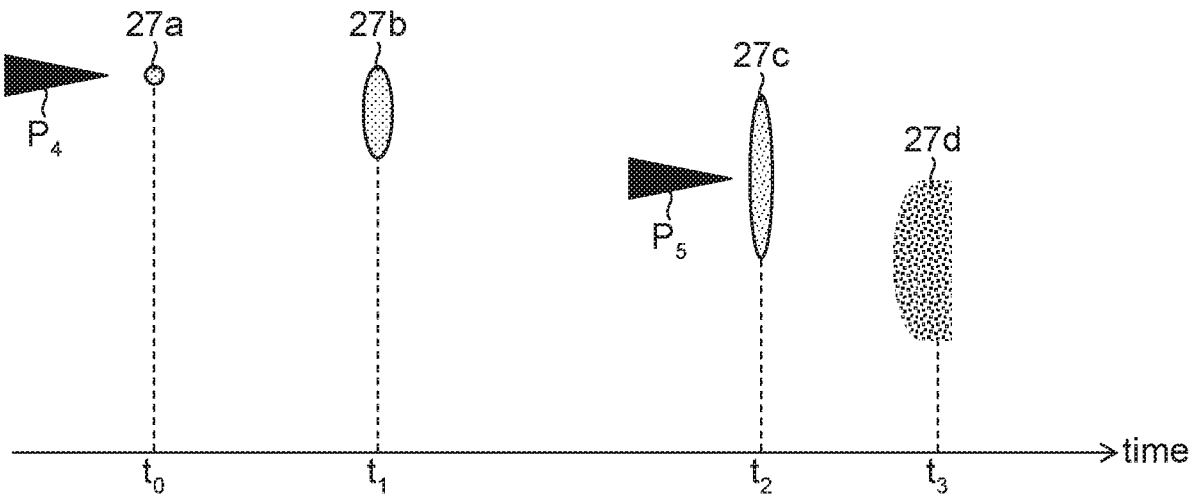
FIG. 4 schematically illustrates a state change of a target substance according to a comparative example.

FIG. 4 schematically illustrates a state change of a target substance according to a comparative example. FIG. 4 illustrates a state of change in the target substance when the target substance is irradiated with fourth pre-pulse laser light $P_4$, and a state of change in the target substance when the target substance that was irradiated with the fourth pre-pulse laser light $P_4$ is irradiated with fifth pre-pulse laser light $P_5$.

In FIG. 4, a direction from left to right represents passage of time. At time $t_0$, the droplet 27*a* is irradiated with the fourth pre-pulse laser light $P_4$. For example, a pulse width of the fourth pre-pulse laser light $P_4$ may be shorter than 1 nanosecond. Frequency of the fourth pre-pulse laser light $P_4$ may be 100 kHz.

The droplet 27*a* irradiated with the fourth pre-pulse laser light $P_4$ becomes a deformed liquid target 27*b* at time $t_1$, and then, becomes a disk-shaped dispersed target 27*c* at time $t_2$.

At time $t_2$, when the disk-shaped dispersed target 27*c* is irradiated with fifth pre-pulse laser light $P_5$, the minute droplets constituting the disk-shaped dispersed target 27*c* are broken into pieces, and becomes a tertiary target 27*d* at time $t_3$. For example, a pulse width of the fifth pre-pulse laser light $P_5$ may be 1 nanosecond or longer.

The tertiary target is in a state where minute droplets are dispersed in a dome shape projecting in a direction opposite to the propagation direction of the fifth pre-pulse laser light $P_5$. The minute droplets constituting the tertiary target 27*d* are dispersed almost equally in a projecting direction. The dispersing velocity of the minute droplets constituting the tertiary target 27*d* may range from about 100 meter per second to about 200 meter per second.

When the tertiary target 27*d* is irradiated with main pulse laser light having a condensing diameter almost equal to the diameter of the tertiary target 27*d*, the tertiary target 27*d* is made into plasma, and EUV light is emitted from the target substance that was made into plasma. Emission of EUV light described with use of FIG. 4 involves the problems provided below.

[Problem 1]

When the energy of the main pulse laser light is increased to increase output of the EUV light, conversion efficiency to the EUV light is lowered. In that case, even if energy of the main pulse laser light is increased, it is difficult to increase the output energy of the EUV light effectively.

[Problem 2]

When the repetition frequency for outputting droplets is increased to increase output of the EUV light, a distance between droplets is shortened. In that case, the target substance made into plasma affects the next droplet, whereby the position of the next droplet is disturbed. Accordingly, radiation state of the pre-pulse laser light to the next droplet in which the position thereof is disturbed becomes unstable.

[Problem 3]

In the case of increasing the output of the EUV light while maintaining the conversion efficiency to the EUV light, it is conceivable to increase the volume and the dispersion range of the droplet along with an increase in the energy of the main pulse laser light, and further, to increase the condensing diameter of the main pulse laser light. However, in the case of increasing the dispersion range of the droplet and the condensing diameter of the main pulse laser light, the expansion range of the target substance that was made into plasma is increased, whereby the light emission size of the EUV light is increased. In that case, limitation of etendue at the intermediate focusing point is exceeded.

[Problem 4]

Particles such as debris components including fragments generated from the target substance adhere to the EUV light condensing mirror, which lowers the reflectance of the EUV light condensing mirror.

5. First Embodiment 5.1 Configuration

Figure 5:
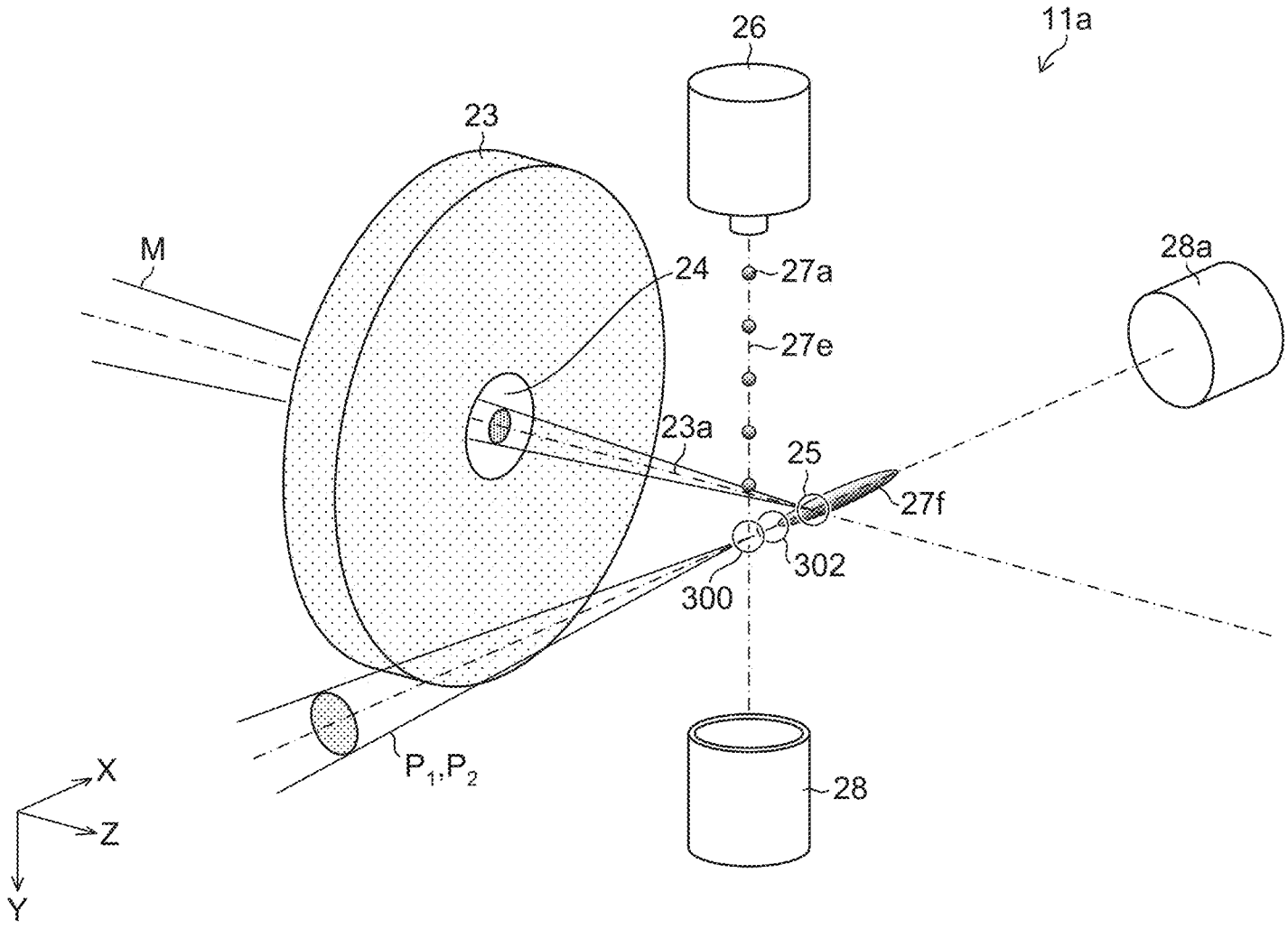
FIG. 5 schematically illustrates a configuration of an EUV light generation system to which an EUV light generation method according to a first embodiment is applied.

FIG. 5 schematically illustrates a configuration of an EUV light generation system to which an EUV light generation method according to a first embodiment is applied. An extreme ultraviolet light generation method corresponds to an EUV light generation method of the present disclosure.

An EUV light generation system 11*a* illustrated in FIG. 5 includes an EUV light condensing mirror 23, a target feeding unit 26, a target recovery unit 28, and a second target recovery unit 28*a*.

The target feeding unit 26 is disposed so as to feed a droplet 27*a* to a first pre-pulse laser light irradiation region 300. A one-dot broken line denoted by a reference sign 27*e* illustrates a path of the droplet 27*a*.

The first laser light condensing optical system 22*a* illustrated in FIG. 2 is disposed such that the propagation direction of the main pulse laser light M illustrated in FIG. 5 is orthogonal to the propagation direction of the first pre-pulse laser light $P_1$ and the propagation direction of the second pre-pulse laser light $P_2$. The propagation direction of the main pulse laser light M may be a direction different from the propagation direction of the first pre-pulse laser light $P_1$.

A direction different from the propagation direction of the first pre-pulse laser light $P_1$ may be a direction that intersects the propagation direction of the first pre-pulse laser light $P_1$ at an angle of 90° or smaller. A direction different from the propagation direction of the first pre-pulse laser light $P_1$ may be a direction that intersects the propagation direction of the first pre-pulse laser light $P_1$ at an angle exceeding 90°.

The propagation direction of the main pulse laser light M may be a direction different from the propagation direction of the second pre-pulse laser light $P_2$. A direction different from the propagation direction of the second pre-pulse laser light $P_2$ may be a direction that intersects the propagation direction of the second pre-pulse laser light $P_2$ at an angle of 90° or smaller. A direction different from the propagation direction of the second pre-pulse laser light $P_2$ may be a direction that intersects the propagation direction of the second pre-pulse laser light $P_2$ at an angle exceeding 90°.

Regarding the propagation direction of the first pre-pulse laser light $P_1$, the plasma generation region 25 is distant from the first pre-pulse laser light irradiation region 300 by a predetermined distance. The first pre-pulse laser light irradiation region 300 is a region different from the plasma generation region 25. Regarding the propagation direction of the second pre-pulse laser light $P_2$, the plasma generation region 25 is distant from the second pre-pulse laser light irradiation region 302 by a predetermined distance. The second pre-pulse laser light irradiation region 302 is a region different from the plasma generation region 25.

The second target recovery unit 28*a* for recovering the target is disposed at a position downstream of the plasma generation region 25 in the propagation direction of the first pre-pulse laser light $P_1$ and the propagation direction of the second pre-pulse laser light $P_2$.

5.2 Operation

The droplet 27*a*, output from the target feeding unit 26 illustrated in FIG. 5, reaches the first pre-pulse laser light irradiation region 300. A droplet output step corresponds to a step of feeding the droplet 27*a* from the target feeding unit 26 to the first pre-pulse laser light irradiation region 300 in the present disclosure. A first laser light irradiation region corresponds to the first pre-pulse laser light irradiation region 300 in the present disclosure.

The droplet 27*a* that reached the first pre-pulse laser light irradiation region 300 is irradiated with the first pre-pulse laser light $P_1$. A deformed liquid target generation step corresponds to a step of irradiating the droplet 27*a* that reached the first pre-pulse laser light irradiation region 300 with the first pre-pulse laser light $P_1$, in the present disclosure.

The deformed liquid target not illustrated in FIG. 5, that is the target substance irradiated with the first pre-pulse laser light $P_1$, is irradiated with the second pre-pulse laser light $P_2$ in the second pre-pulse laser light irradiation region 302. In the present disclosure, the propagation direction of the second pre-pulse laser light $P_2$ agrees with the propagation direction of the first pre-pulse laser light $P_1$.

A fragment jet target generation step includes a step of irradiating a deformed liquid target with the second pre-pulse laser light $P_2$ that propagates in the same direction as the propagation direction of the first pre-pulse laser light $P_1$, in the present disclosure. A second laser light irradiation region corresponds to the second pre-pulse laser light irradiation region 302 in the present disclosure.

When the deformed liquid target is irradiated with the second pre-pulse laser light $P_2$, a fragment jet target 27*f* is generated. A fragment jet target generation step corresponds to a step of irradiating the deformed liquid target that reached the second pre-pulse laser light irradiation region 302 with the second pre-pulse laser light $P_2$, in the present disclosure.

The fragment jet target 27*f* travels along the propagation direction of the second pre-pulse laser light $P_2$. When at least a part of the fragment jet target 27*f* reaches the plasma generation region 25, the fragment jet target 27*f* that reached the plasma generation region 25 is irradiated with the main pulse laser light M. When the fragment jet target 27*f* is irradiated with the main pulse laser light M, the fragment jet target 27*f* irradiated with the main pulse laser light M is made into plasma, and EUV light is emitted from the target substance that was made into plasma.

A third laser light irradiation step corresponds to a step of irradiating the fragment jet target 27*f* that reached the plasma generation region 25 with the main pulse laser light M, in the present disclosure.

A debris component such as a fragment remaining after irradiation of the main pulse laser light M is recovered by the second target recovery unit 28*a*. A first recover step corresponds to a step of recovering a debris component such as a fragment remaining after irradiation of the main pulse laser light M, by the second target recovery unit 28*a*. A particle moving toward a downstream side of the plasma generation region in the propagation direction of the second laser light may contain a debris component such as a fragment remaining after irradiation of the main pulse laser light M.

5.3 Change in State of Target Substance

Figure 6:
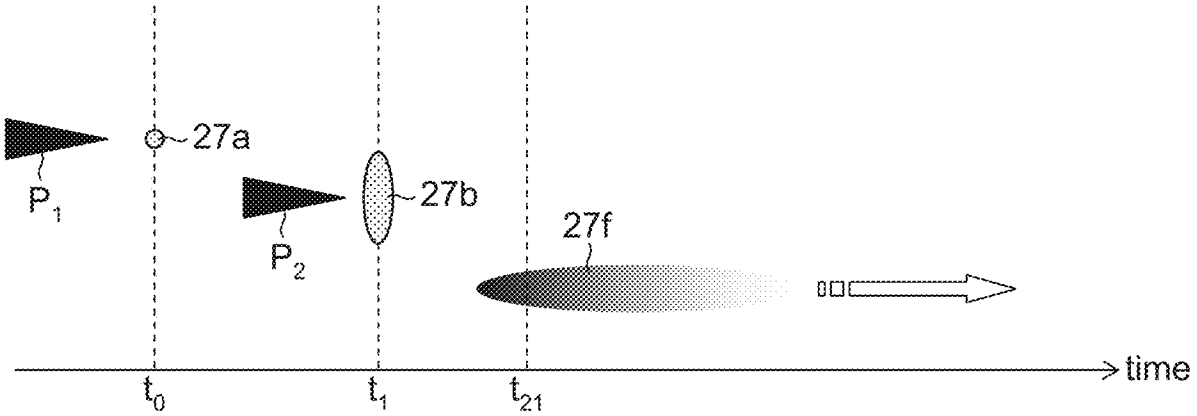
FIG. 6 schematically illustrates a change in a target substance.

FIG. 6 schematically illustrates a change in a target substance. FIG. 6 illustrates a state of change in the target substance when it is irradiated with the first pre-pulse laser light $P_1$ and the second pre-pulse laser light $P_2$, and a state of change in the target substance when it is irradiated with the main pulse laser light M.

At time $t_0$, when the droplet 27*a* is irradiated with the first pre-pulse laser light $P_1$, the deformed liquid target 27*b* is generated. A pulse width of the first pre-pulse laser light $P_1$ may be 1.0 nanosecond or longer.

The deformed liquid target generation step may include an aspect that the droplet 27*a* is irradiated with the first pre-pulse laser light $P_1$ having a pulse width of 1.0 nanosecond or longer.

A period from time $t_0$ to time $t_1$ is a period in which at least a part of the deformed liquid target 27*b* can maintain a droplet state. A droplet state is a state where the interface of the deformed liquid target 27*b* has a single closed curved surface.

The deformed liquid target 27*b* is a disk-shaped droplet having a predetermined thickness in the propagation direction of the first pre-pulse laser light $P_1$, and extending in a direction orthogonal to the propagation direction of the first pre-pulse laser light $P_1$. The deformed liquid target 27*b* may include at least one of a shape in which a position irradiated with the first pre-pulse laser light $P_1$ is recessed and a shape in which surrounding portion of the position irradiated with the first pre-pulse laser light $P_1$ is recessed.

At time $t_1$, during the period that the droplet state of the deformed liquid target 27*b* is maintained, when the deformed liquid target 27*b* is irradiated with the second pre-pulse laser light $P_2$, the fragment jet target 27*f* is generated. A pulse width of the second pre-pulse laser light $P_2$ may be 100 femtoseconds or longer but shorter than 1.0 nanosecond.

The fragment jet target generation step may include an aspect of irradiating the deformed liquid target 27*b* with the second pre-pulse laser light $P_2$ having a pulse width of 100 femtoseconds or longer but shorter than 1.0 nanosecond, in the present disclosure.

An upper limit value of the pulse width of the second pre-pulse laser light $P_2$ may be determined from a viewpoint of energy intensity of the second pre-pulse laser light $P_2$ at which dispersion of the target substance becomes insufficient. An upper limit value of the pulse width of the second pre-pulse laser light $P_2$ may be determined from a viewpoint of energy intensity of the second pre-pulse laser light $P_2$ at which a part of the target substance is not ionized. An upper limit value of the pulse width of the second pre-pulse laser light $P_2$ may be determined from a viewpoint of temporal limitation of expansion of the target substance. An upper limit value of the pulse width of the second pre-pulse laser light $P_2$ may be determined from a viewpoint of temporal limitation of dispersion of the target substance.

The fragment jet target 27*f* is a form of a target substance in which particles of the target substance constituting the fragment jet target 27*f* are dispersed in the form of jet in the propagation direction of the second pre-pulse laser light $P_2$.

The fragment jet target 27*f* is a form of a target substance after the scattered ions are disappeared. An ion may be generated by radiation of the first pre-pulse laser light $P_1$ to the droplet 27*a*. An ion may be generated by radiation of the second pre-pulse laser light $P_2$ to the deformed liquid target 27*b*.

A third laser light irradiation step may include an aspect of irradiating the fragment jet target with the main pulse laser light M after ions are scattered and disappeared in the present disclosure.

Figure 7:
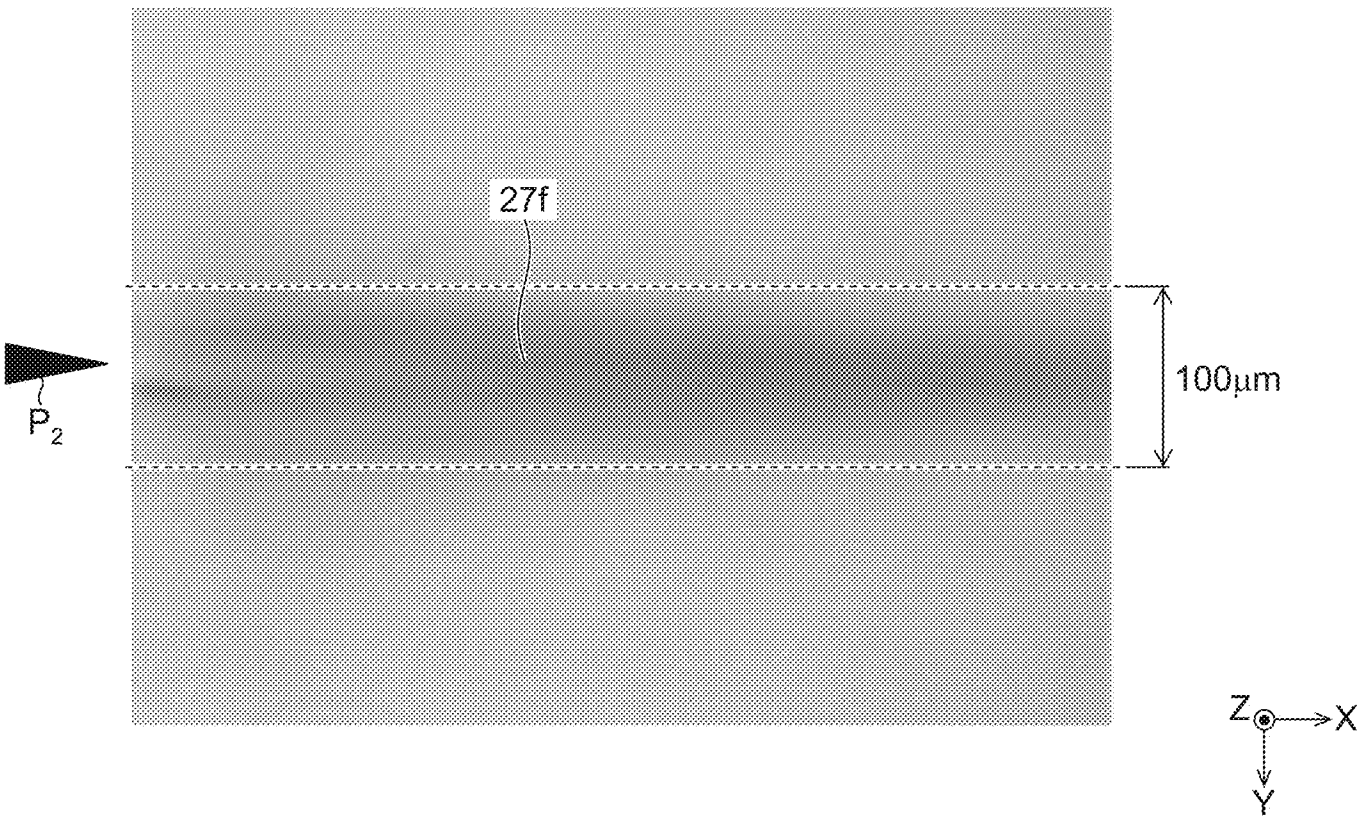
FIG. 7 is an image in which a fragment jet target is captured.

FIG. 7 is an image in which a fragment jet target is captured. An image of the fragment jet target 27*f* illustrated in FIG. 7 is acquired by capturing the actually generated fragment jet target 27*f* at a certain time. A direction from left to right in FIG. 7 is a propagation direction of the second pre-pulse laser light $P_2$. As illustrated in FIG. 7, the fragment jet target 27*f* has high directivity in the propagation direction of the second pre-pulse laser light $P_2$.

A travel velocity of the fragment jet target 27*f*, obtained by analyzing the image of the fragment jet target 27*f* illustrated in FIG. 7, almost ranges from 1 kilometer per second to 100 kilometers per second. Further, a length of a direction orthogonal to the travel direction of the fragment jet target 27*f* is about 100 micrometers. Exemplary parameters and specs of the first pre-pulse laser light $P_1$ in generation of the fragment jet target 27*f* are as described below.

Droplet diameter: 25 micrometers to 30 micrometers

Pulse width of first pre-pulse laser light: 6.0 nanoseconds

Energy density of first pre-pulse laser light when droplet diameter is 25 micrometers: 4.0 joules per square centimeter ($J/cm^2$)

Energy density of first pre-pulse laser light when droplet diameter is 30 micrometers: 34.0 joules per square centimeter Note that energy density may be fluence.

Condensing diameter of first pre-pulse laser light: 250 micrometers

Pulse width range: 1.0 nanosecond to 100 nanoseconds

Fluence range: 0.1 joules per square centimeter to 100 joules per square centimeter, Preferably 17.0 joules per square centimeter to 52.0 joules per square centimeter.

Exemplary parameters and specs of the second pre-pulse laser light $P_2$ in generation of the fragment jet target 27*f* are as described below.

Pulse width of second pre-pulse laser light: 14.0 picoseconds

Energy density of second pre-pulse laser light: 1.0 joule per square centimeter

Condensing diameter of second pre-pulse laser light: 300 micrometers

Delay period from first pre-pulse laser light: 1.0 microsecond

It is also acceptable to set an arbitrary period from 0.4 micrometers to 1.2 micrometers.

Pulse width range: 1.0 picosecond to 500 picoseconds

Fluence range: 0.1 joules per square centimeter to 100 joules per square centimeter Preferably, 0.5 joules per square centimeter to 6.2 joules per square centimeter.

Further, wavelengths of the first pre-pulse laser light $P_1$ and the second pre-pulse laser light $P_2$ may be similar, for example, 1.06 micrometers.

In the case where the pulse width of the second pre-pulse laser light $P_2$ is 100 femtoseconds or longer but shorter than 50 picoseconds, the second pre-pulse laser device that outputs the second pre-pulse laser light $P_2$ may have a configuration in which a mode lock laser is used as an oscillator. In the case where the pulse width of the second pre-pulse laser light $P_2$ is 150 picoseconds or longer, the second pre-pulse laser device that outputs the second pre-pulse laser light $P_2$ may have a configuration in which a semiconductor laser is used as an oscillator.

Even in the case where the pulse width of the second pre-pulse laser light $P_2$ is 1 femtosecond or longer but shorter than 100 femtoseconds, the same effect as that of the case where the pulse width of the second pre-pulse laser light $P_2$ is 100 femtoseconds or longer but shorter than 50 picoseconds can be expected. In the case where the pulse width of the second pre-pulse laser light $P_2$ is 1 femtosecond or longer but shorter than 100 femtoseconds, the second pre-pulse laser device that outputs the second pre-pulse laser light $P_2$ may use a regenerative mode lock laser. The second pre-pulse laser device may use Kerr lens mode locking, for example.

In the case where the pulse width of the first pre-pulse laser light $P_1$ is several nanoseconds or longer but shorter than several tens nanoseconds, the first pre-pulse laser device that outputs the first pre-pulse laser light $P_1$ may have a configuration in which Q switch oscillation is applied. In the case where the pulse width of the first pre-pulse laser light $P_1$ is several tens nanoseconds or longer, the first pre-pulse laser device that outputs the first pre-pulse laser light $P_1$ may use a MOPA configuration.

For example, it is possible to use a semiconductor laser, a CW laser, or the like as an oscillator, and laser light is temporarily cut out by an optical switch or the like disposed on the optical path to thereby be able to generate the first pre-pulse laser light $P_1$ having a desired pulse width. MOPA is an abbreviation of master oscillator power amplifier. CW is an abbreviation of continuous wave.

5.4 Main Pulse Laser Light

Figure 8:
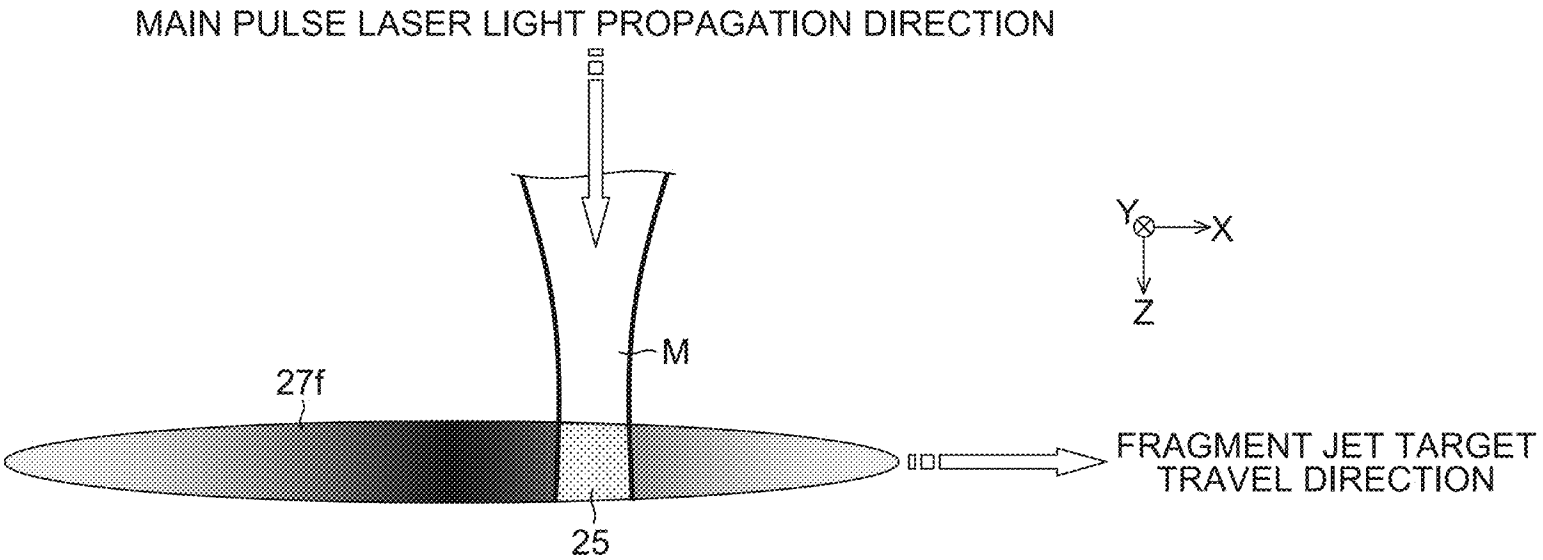
FIG. 8 illustrates a relationship between a travel direction of a fragment jet target and a propagation direction of main pulse laser light.

FIG. 8 illustrates a relationship between the propagation direction of the main pulse laser light and the travel direction of the fragment jet target. The travel direction of the fragment jet target 27*f* in the present disclosure agrees with the propagation direction of the second pre-pulse laser light $P_2$ illustrated in FIG. 5. In the present disclosure, the travel direction of the fragment jet target 27*f* may be the propagation direction of the first pre-pulse laser light $P_1$.

Hereinafter, the travel direction of the fragment jet target 27*f* may be replaced with the propagation direction of the second pre-pulse laser light $P_2$. The travel direction of the fragment jet target 27*f* may be replaced with the propagation direction of the first pre-pulse laser light $P_1$.

As illustrated in FIG. 8, the propagation direction of the main pulse laser light M is a direction parallel to the plus Z direction, and is a direction orthogonal to the travel direction of the fragment jet target 27*f*. The propagation direction of the main pulse laser light M may be a direction orthogonal to the travel direction of the fragment jet target 27*f*.

The third laser light irradiation step may include an aspect of radiating the main pulse laser light M that propagates in a direction orthogonal to the travel direction of the fragment jet target 27*f*, in the present disclosure.

Figure 9:
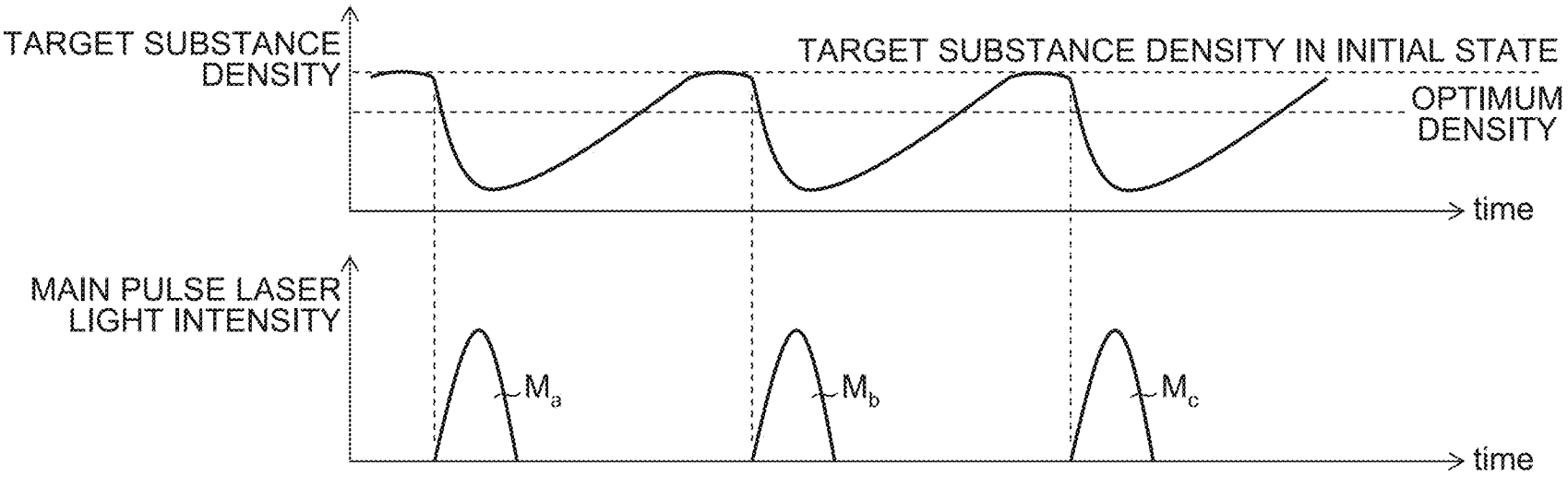
FIG. 9 illustrates a relationship between a density of a target substance and a radiation timing of main pulse laser light in a plasma generation region.

FIG. 9 illustrates a relationship between the density of the target substance and the radiation timing of the main pulse laser light in the plasma generation region. In FIG. 9, a direction from left to right represents passage of time. The fragment jet target 27*f* generated by single radiation of the second pre-pulse laser light $P_2$ has a target substance density that is higher than the optimum density in the initial state. Optimum density of the fragment jet target 27*f* is density of a target substance optimum for generating EUV light.

When the fragment jet target 27*f* is irradiated with a first pulse Ma of the main pulse laser light M in the plasma generation region 25, at least a part of the fragment jet target 27*f* is made into plasma in the plasma generation region 25. EUV light is emitted from the target substance made into plasma. After the first pulse Ma is radiated, the density of the target substance in the plasma generation region 25 is decreased as time passes. As illustrated in FIG. 9, the density of the target substance in the plasma generation region 25 may become less than the optimum density.

The target substance is moved at a high speed in the travel direction of the fragment jet target 27*f*. Accordingly, the target substance is fed from the upstream side in the travel direction of the fragment jet target 27*f* to the plasma generation region 25. The density of the target substance in the plasma generation region 25 may become recovered to the optimum density or higher.

When the density of the target substance in the plasma generation region 25 becomes the optimum density or higher, it is possible to radiate the second pulse $M_b$ of the main pulse laser light M. After radiation of the second pulse $M_b$ of the main pulse laser light M to the fragment jet target 27*f*, it is possible to radiate a third pulse $M_c$ of the main pulse laser light M after a period until the density of the target substance in the plasma generation region 25 becomes the optimum density or higher.

The main pulse laser light M may be continued temporarily. In the case of radiating the main pulse laser light M that is continued temporarily, the density of the target substance in the plasma generation region 25 may be maintained at the optimum density or higher. A decrease in the density of the target substance due to expansion of the target substance caused by generation of plasma and an increase in the density of the target substance due to movement of the target substance in the fragment jet target 27*f* may be balanced.

The third laser light irradiation step may include an aspect that second main pulse laser light $M_2$ is radiated after first main pulse laser light $M_1$ is radiated and after a period in which the density of the target substance in the plasma generation region 25 is recovered to the optimum density or higher in the present disclosure.

5.5 Effect

When the density of the target substance in the plasma generation region 25 is decreased due to radiation of the main pulse laser light M, the target substance in the fragment jet target 27*f* travels, whereby the target substance is fed to the plasma generation region 25.

Accordingly, it is possible to use main pulse laser light having a plurality of pulses, main pulse laser light having a long pulse width, or main pulse laser light continued temporarily, without lowering the conversion efficiency to the EUV light due to a decrease in the density of the target substance.

The first pre-pulse laser light irradiation region 300 and the plasma generation region 25 are separated from each other by a predetermined distance. Thereby, it is possible to suppress disturbance of the trajectory of the following droplet by the target substance made into plasma, and the positional stableness of the droplet 27*a* in the first pre-pulse laser light irradiation region 300 can be improved.

Pulse laser light having a plurality of pulses separated by a period that the density of the target substance in the plasma generation region 25 becomes the optimum density or higher can be used as the main pulse laser light M. Thereby, output energy per unit time of the EUV light can be improved. Further, it is possible to suppress radiation intensity of the main pulse laser light M per pulse, whereby it is possible to suppress enlargement of the condensing diameter of the EUV light due to expansion of the target substance made into plasma.

The fragment jet target 27*f* that is in the form of jet and that the target substance travels at a high speed is fed to the plasma generation region 25. Thereby, the initial velocity of the fragment jet target 27*f* is acted on the debris component such as a fragment remaining after at least a part of the fragment jet target 27*f* is made into plasma, as inertia, and the debris component can be recovered by the second target recovery unit 28*a*. Accordingly, adhesion of a debris component to the EUV light condensing mirror 23 can be suppressed.

6. Second Embodiment 6.1 Configuration

Figure 10:
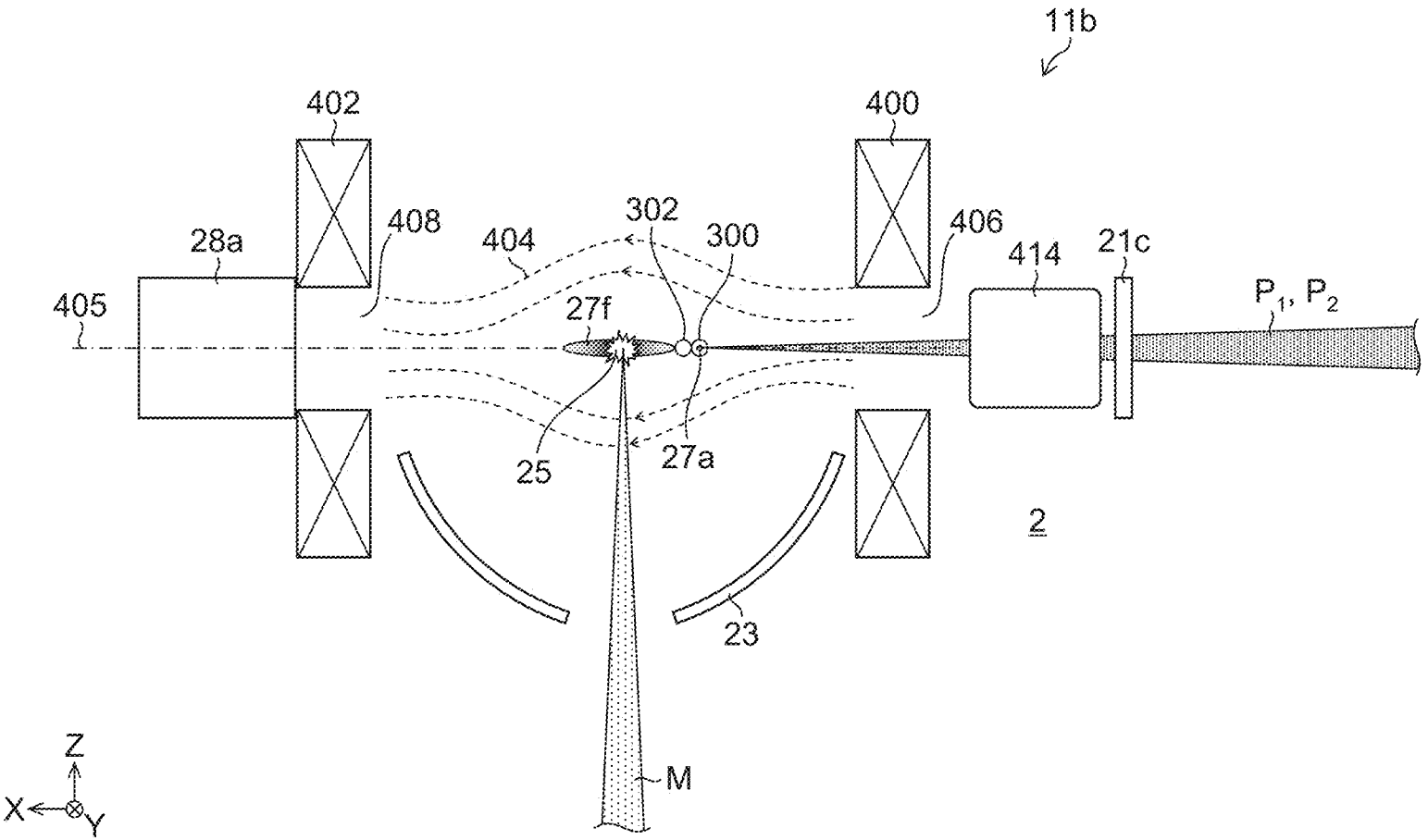
FIG. 10 schematically illustrates a configuration of an EUV light generation system to which an EUV light generation method according to a second embodiment is applied.

FIG. 10 schematically illustrates a configuration of an EUV light generation system to which an EUV light generation method according to a second embodiment is applied. An EUV light generation system 11*b* illustrated in FIG. 10 includes a first solenoid magnet 400 and a second solenoid magnet 402 on the optical paths of the first pre-pulse laser light $P_1$ and the second pre-pulse laser light $P_2$ inside the chamber 2.

The EUV light generation system 11*b* includes the first solenoid magnet 400 and the second solenoid magnet 402. The first solenoid magnet 400 and the second solenoid magnet 402 are disposed on both sides of the EUV light condensing mirror 23 over the EUV light condensing mirror 23, in the propagation direction of the first pre-pulse laser light $P_1$ and the propagation direction of the second pre-pulse laser light $P_2$.

The first solenoid magnet 400 is disposed at a position upstream of the EUV light condensing mirror 23 in the propagation direction of the first pre-pulse laser light $P_1$ and the propagation direction of the second pre-pulse laser light $P_2$. The second solenoid magnet 402 is disposed at a position downstream of the EUV light condensing mirror 23 in the propagation direction of the first pre-pulse laser light $P_1$ and the propagation direction of the second pre-pulse laser light $P_2$.

A magnetic field is generated between the first solenoid magnet 400 and the second solenoid magnet 402. A broken line denoted by a reference numeral 404 represents a magnetic flux line of the magnetic field generated between the first solenoid magnet 400 and the second solenoid magnet 402. An arrow of a broken line denoted by a reference numeral 404 represents the orientation of the magnetic field.

The first solenoid magnet 400 has a first through hole 406 that allows the first pre-pulse laser light $P_1$, the second pre-pulse laser light $P_2$, and debris components of the target substance to pass through. The second solenoid magnet 402 has a second through hole 408 that enables particles such as debris components of the target substance to pass through.

The propagation direction of the first pre-pulse laser light $P_1$ and the propagation direction of the second pre-pulse laser light $P_2$ may be directions parallel to a magnetic field axis 405 of the magnetic field generated by the first solenoid magnet 400) and the second solenoid magnet 402. The propagation direction of the main pulse laser light M is the same direction as that of a light condensing axis 23*a* of the EUV light condensing mirror 23.

The EUV light generation system 11*b* includes a first debris suppression device 414. The first debris suppression device 414 is disposed at a position between a window 21*c* and the first solenoid magnet 400 in the propagation direction of the first pre-pulse laser light $P_1$ and the propagation direction of the second pre-pulse laser light $P_2$.

A second target recovery unit 28*a* is disposed at a position downstream of the second solenoid magnet 402 in the propagation direction of the first pre-pulse laser light $P_1$ and the propagation direction of the second pre-pulse laser light $P_2$.

A first introduction window corresponds to the window 21*c* for introducing the first pre-pulse laser light $P_1$ and the second pre-pulse laser light $P_2$. A second introduction window corresponds to the window 21*c* for introducing the first pre-pulse laser light $P_1$ and the second pre-pulse laser light $P_2$. In the present disclosure, the first introduction window and the second introduction window are common.

6.2 Operation

When the fragment jet target 27*f* is irradiated with the main pulse laser light M, debris components of the target substance are generated. Some charged particles such as ions among the debris components move along the magnetic flux line 404. The debris components are guided to the second through hole 408 of the second solenoid magnet 402 due to an action of the magnetic field. The debris components guided to the second through hole 408 of the second solenoid magnet 402 are recovered by the second target recovery unit 28*a*.

The initial velocity of the fragment jet target 27*f* is acted on the electrically neutral particles such as neutral atoms and fragments among the debris components, as inertia, whereby the electrically neutral particles move toward the second target recovery unit 28*a*. Electrically neutral particles such as fragments are recovered by the second target recovery unit 28*a*. A first recovery step may include a step of recovering particles such as debris components moving toward the second target recovery unit 28*a*.

The debris components moving toward the first solenoid magnet 400 passes through the first through hole 406 of the first solenoid magnet 400, and are recovered by the first debris suppression device 414. A magnetic field generation step corresponds to a step of generating a magnetic field between the first solenoid magnet 400 and the second solenoid magnet 402 in the present disclosure.

6.3 Debris Suppression Device

Figure 11:
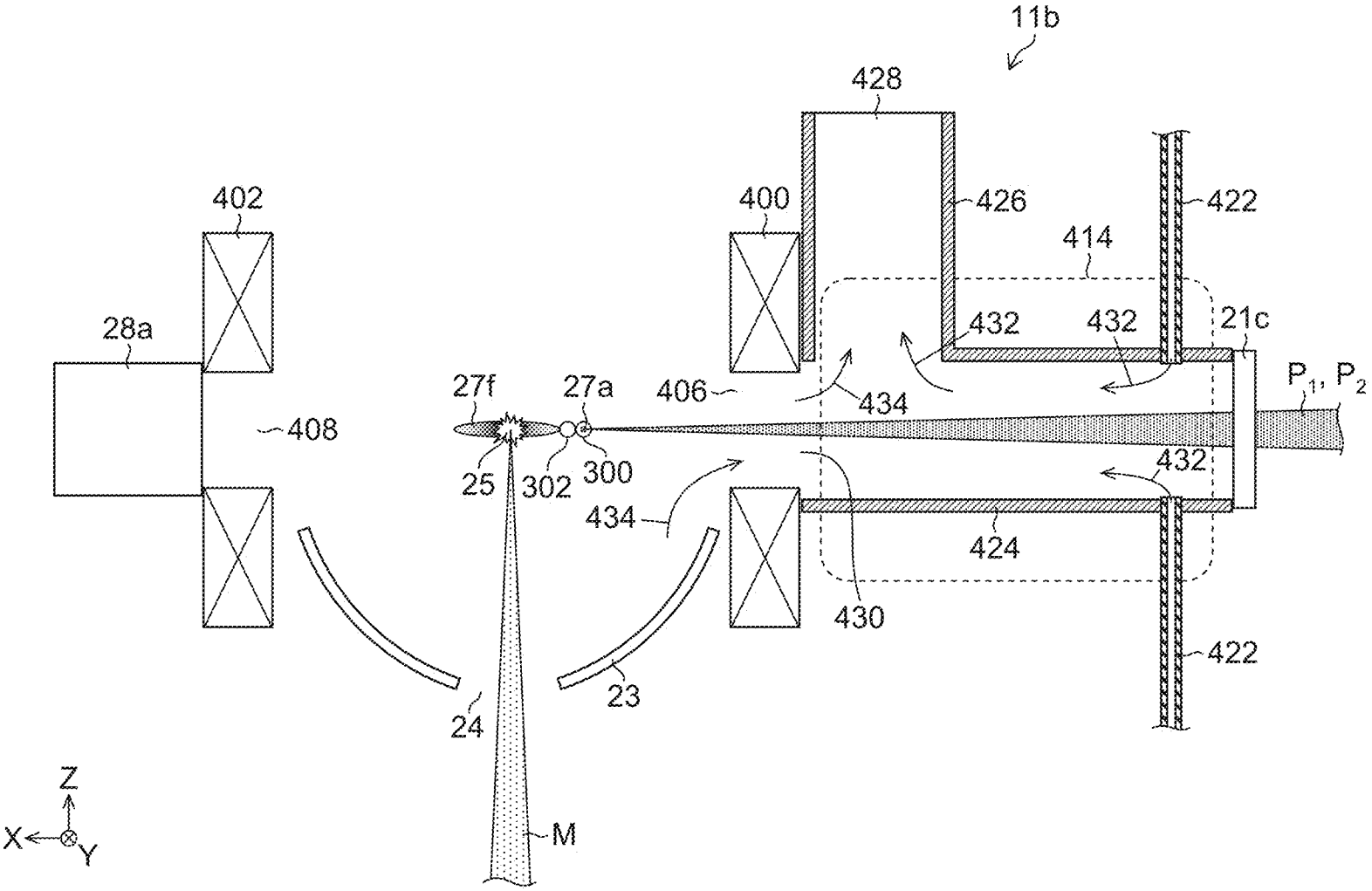
FIG. 11 schematically illustrates a configuration of a first debris suppression device illustrated in FIG. 10.

FIG. 11 is a partial cross-sectional view schematically illustrating a configuration of the first debris suppression device illustrated in FIG. 10. The first debris suppression device 414 illustrated in FIG. 11 includes a gas introduction part 422, a laser optical path pipe 424, and a discharge pipe 426. The discharge pipe 426 communicates with a first discharge port 428. The laser optical path pipe 424 communicates with an introduction port 430.

A curved line with an arrow denoted by a reference numeral 432 represents a flow of gas introduced from the gas introduction part 422 to the laser optical path pipe 424. A curved line with an arrow denoted by a reference numeral 434 represents a flow of gas from a side of the EUV light condensing mirror 23 to a side of the first debris suppression device 414.

In the first debris suppression device 414 illustrated in FIG. 11, the first discharge port 428 is provided on the side of the introduction port 430 of the laser optical path pipe 424. However, layout of the first discharge port 428 is not limited to that illustrated in FIG. 11. The first discharge port 428 may be disposed in any layout if the travel direction of the gas introduced from the gas introduction part 422 is a direction separating from the window 21*c* for introducing the first pre-pulse laser light $P_1$ and the second pre-pulse laser light $P_2$. The first discharge port 428 may be connected with a discharge device not illustrated such as a pump.

While FIG. 11 illustrates two gas introduction parts 422, three or more gas introduction parts 422 may be provided. The gas introduction part 422 may have a ring-shaped slit provided around the window 21*c*.

At least part of the particles of debris components moving toward the first solenoid magnet 400 among the particles dispersed inside the chamber 2 moves toward the window 21*c* and flows into the laser optical path pipe 424 by a gas flow in the chamber 2. The particles dispersed in the chamber 2 may include charged particles such as ions. The particles dispersed in the chamber 2 may include neutral atoms dispersed in the gas in the chamber 2 or electrically neutral particles such as fragments.

The first debris suppression device 414 introduces gas from the gas introduction part 422 toward the laser optical path pipe 424. The pressure of the gas introduced from the gas introduction part 422 in the laser optical path pipe 424 may be pressure with which particles such as debris components flowing into the laser optical path pipe 424 stand still in the laser optical path pipe 424. Alternatively, the pressure of the gas introduced from the gas introduction part 422 in the laser optical path pipe 424 may be pressure with which particles such as debris components flowing into the laser optical path pipe 424 flow to the first discharge port 428 by the gas flow in the laser optical path pipe 424.

Particles of the debris components flowing into the laser optical path pipe 424 via the introduction port 430 stand still in the laser optical path pipe 424, and is discharged from the first discharge port 428. A second recovery step corresponds to a step of recovering particles moving toward the window 21*c* with use of the first debris suppression device in the present disclosure.

6.4 Effect

The first solenoid magnet 400 is disposed at a position upstream of the EUV light condensing mirror 23 in the propagation direction of the first pre-pulse laser light $P_1$ and the propagation direction of the second pre-pulse laser light $P_2$. Further, the second solenoid magnet 402 is disposed at a position downstream of the EUV light condensing mirror 23. A magnetic field oriented in a direction parallel to the propagation direction of the first pre-pulse laser light $P_1$ and the propagation direction of the second pre-pulse laser light $P_2$ is generated. Thereby, particles of debris components and the like traveling in the propagation direction of the first pre-pulse laser light $P_1$ and the propagation direction of the second pre-pulse laser light $P_2$ can be recovered with use of the second target recovery unit 28*a* for recovering the target substance.

The first debris suppression device 414 is disposed at a position upstream of the EUV light condensing mirror 23 in the propagation direction of the first pre-pulse laser light $P_1$ and the propagation direction of the second pre-pulse laser light $P_2$. Thereby, particles of the debris components and the like flowing toward the window 21*c* can be recovered.

7. Third Embodiment 7.1 Configuration

Figure 12:
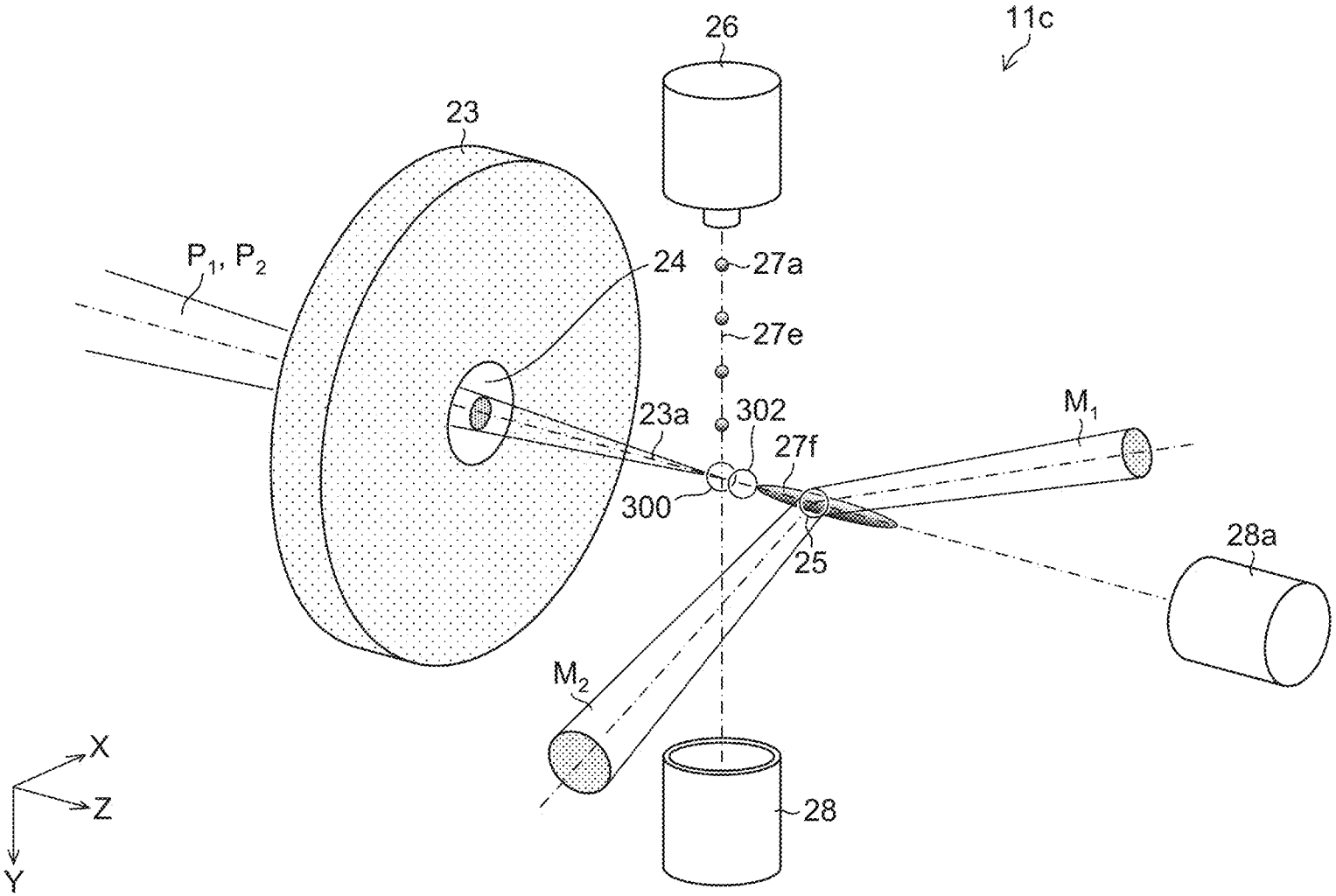
FIG. 12 schematically illustrates a configuration of an EUV light generation system to which an EUV light generation method according to a third embodiment is applied.

FIG. 12 schematically illustrates a configuration of an EUV light generation system to which an EUV light generation method according to a third embodiment is applied. The EUV light generation system 11*c* illustrated in FIG. 12 has a laser device not illustrated that radiates the first pre-pulse laser light $P_1$ and the second pre-pulse laser light $P_2$ via a through hole 24 provided at a center portion of the EUV light condensing mirror 23. The EUV light generation system 11*c* illustrated in FIG. 12 has a pre-pulse laser light transmission device, not illustrated, that transmits the first pre-pulse laser light $P_1$ and the second pre-pulse laser light $P_2$.

Further, the EUV light generation system 11*c* illustrated in FIG. 12 also has a laser device not illustrated and a main pulse laser light transmission device not illustrated for radiating the first main pulse laser light $M_1$ and the second main pulse laser light $M_2$. The first main pulse laser light $M_1$ and the second main pulse laser light $M_2$ are a plurality of beams of the main pulse laser light M that are made incident from different directions.

The first main pulse laser light $M_1$ and the second main pulse laser light $M_2$ may be output from one laser device or output from different laser devices. The propagation direction of the first main pulse laser light $M_1$ and the propagation direction of the second main pulse laser light $M_2$ are directions orthogonal to the travel direction of the fragment jet target 27*f*. The propagation direction of the first main pulse laser light $M_1$ and the propagation direction of the second main pulse laser light $M_2$ may intersect the travel direction of the fragment jet target 27*f* at an angle equal to or smaller than 90° or an angle larger than 90°.

The propagation direction of the first main pulse laser light $M_1$ and the propagation direction of the second main pulse laser light $M_2$ may be opposite directions or parallel directions. The propagation direction of the first main pulse laser light $M_1$ and the propagation direction of the second main pulse laser light $M_2$ may be intersecting directions. The first main pulse laser light $M_1$ and the second main pulse laser light $M_2$ may be radiated to the same position in the travel direction of the fragment jet target 27*f* in the plasma generation region 25, or radiated to different positions.

The first main pulse laser light $M_1$ and the second main pulse laser light $M_2$ may be radiated to the fragment jet target 27*f* simultaneously. The second main pulse laser light $M_2$ may have a delay time that is shorter than the pulse width of the first main pulse laser light $M_1$ from the radiation timing of the first main pulse laser light $M_1$.

The beam profiles of the first main pulse laser light $M_1$ and the second main pulse laser light $M_2$ in the plasma generation region 25 may be the same or may be different from each other.

The condensing diameters of the first main pulse laser light $M_1$ and the second main pulse laser light $M_2$ in the plasma generation region 25 may be the same or may be different from each other.

7.2 Operation

When the first pre-pulse laser light $P_1$ passing through the through hole 24 irradiates the droplet 27*a*, and the second pre-pulse laser light $P_2$ irradiates a deformed liquid target not illustrated, the fragment jet target 27*f* that travels in the plus Z direction is generated.

The fragment jet target 27*f* traveling in the plus Z direction is irradiated with the first main pulse laser light $M_1$ and the second main pulse laser light $M_2$, whereby at least a part of the fragment jet target 27*f* is made into plasma. EUV light is radiated from the target substance made into plasma.

The third laser light irradiation step may include an aspect of irradiating the fragment jet target 27*f* with the first main pulse laser light $M_1$ and the second main pulse laser light $M_2$, in the present disclosure.

7.3 Effect

The fragment jet target 27*f* is irradiated with the first main pulse laser light $M_1$ and the second main pulse laser light $M_2$ that are a plurality of beams of the main pulse laser light M from directions different from each other. Thereby, radiation of EUV light in the plasma generation region 25 is unified.

Thereby, it is possible to increase the total output of the main pulse laser light M without increasing the output of each of the first main pulse laser light $M_1$ and the second main pulse laser light $M_2$, whereby output of the EUV light can be improved.

It is possible to suppress output of each of the first main pulse laser light $M_1$ and the second main pulse laser light $M_2$, and to suppress at least any of thermal variation, deterioration, and damage of the optical system of the main pulse laser light M.

7.4 Modification

Figure 13:
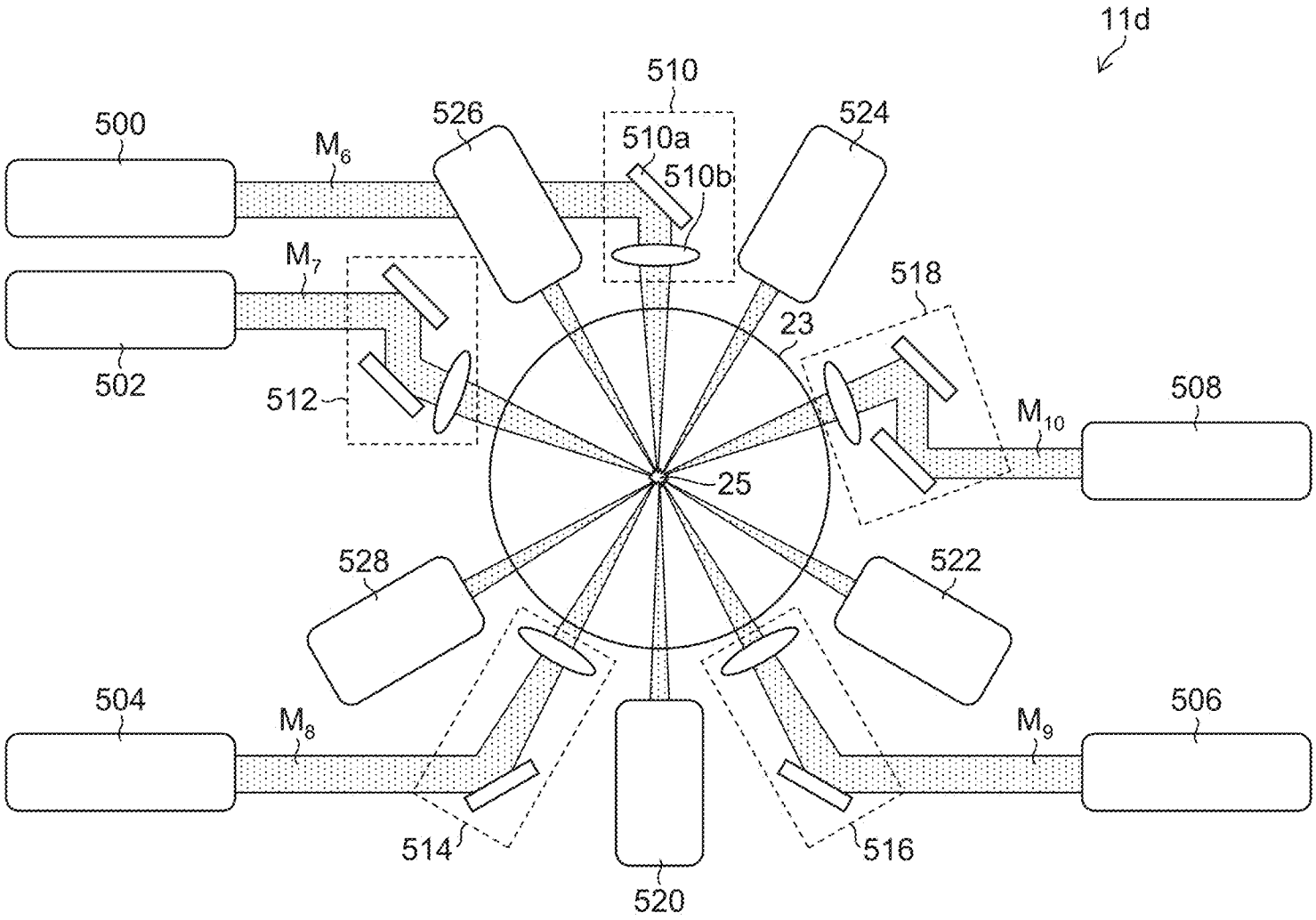
FIG. 13 schematically illustrates a configuration of an EUV light generation system to which an EUV light generation method according to a modification of the third embodiment is applied.

FIG. 13 schematically illustrates a configuration of an EUV light generation system to which an EUV light generation method according to a modification of the third embodiment is applied. An EUV light generation system 11*d* illustrated in FIG. 13 uses five beams of main pulse laser light M. A direction penetrating the sheet of FIG. 13 from the rear face to the front face is a travel direction of the fragment jet target 27*f*. A direction penetrating the sheet of FIG. 13 from the rear face to the front face is a plus Z direction.

The EUV light generation system 11*d* includes a sixth laser device 500, a seventh laser device 502, an eighth laser device 504, a ninth laser device 506, and a tenth laser device 508. The EUV light generation system 11*d* includes a sixth main light transmission device 510, a seventh main light transmission device 512, an eighth main light transmission device 514, a ninth main light transmission device 516, and a tenth main light transmission device 518. Each of the sixth to tenth main light transmission devices 510 to 518 includes at least any of one or more position adjustment mirrors and one or more light condensing optical systems.

For example, the sixth main light transmission device 510 includes a position adjustment mirror 510*a* and a light condensing optical system 510*b*. In the drawings, reference signs of the position adjustment mirrors and the light condensing optical systems of the seventh main light transmission device 512, the eighth main light transmission device 514, the ninth main light transmission device 516, and the tenth main light transmission device 518 are omitted.

The sixth main light transmission device 510 condenses sixth main pulse laser light $M_6$ output from the sixth laser device 500 on the plasma generation region 25. The seventh main light transmission device 512 condenses seventh main pulse laser light $M_7$ output from the seventh laser device 502 on the plasma generation region 25. The eighth main light transmission device 514 condenses eighth main pulse laser light Ms output from the eighth laser device 504 on the plasma generation region 25.

The ninth main light transmission device 516 condenses ninth main pulse laser light $M_9$ output from the ninth laser device 506 on the plasma generation region 25. The tenth main light transmission device 518 condenses tenth main pulse laser light $M_{10}$ output from the tenth laser device 508 on the plasma generation region 25.

The EUV light generation system 11*d* may include a sixth damper 520, a seventh damper 522, an eighth damper 524, a ninth damper 526, and a tenth damper 528. The sixth damper 520 is disposed on a side opposite to the sixth main light transmission device 510 over the plasma generation region 25 in the propagation direction of the sixth main pulse laser light $M_6$.

The sixth damper 520 may be disposed on the inner wall of the chamber 2, or on the outside of the chamber 2 over a window disposed on the inner wall of the chamber 2. The seventh damper 522, the eighth damper 524, the ninth damper 526, and the tenth damper 528 may be disposed similar to the sixth damper 520.

The sixth damper 520 absorbs the sixth main pulse laser light $M_6$ not radiated to the target substance and passing through the plasma generation region 25. The seventh damper 522, the eighth damper 524, the ninth damper 526, and the tenth damper 528 have a function similar to that of the sixth damper 520.

The third laser light irradiation step may include an aspect of irradiating the fragment jet target 27*f* with the sixth to tenth main pulse laser light $M_6$ to $M_{10}$ in the present disclosure.

8. Fourth Embodiment

8.1 Configuration

Figure 14:
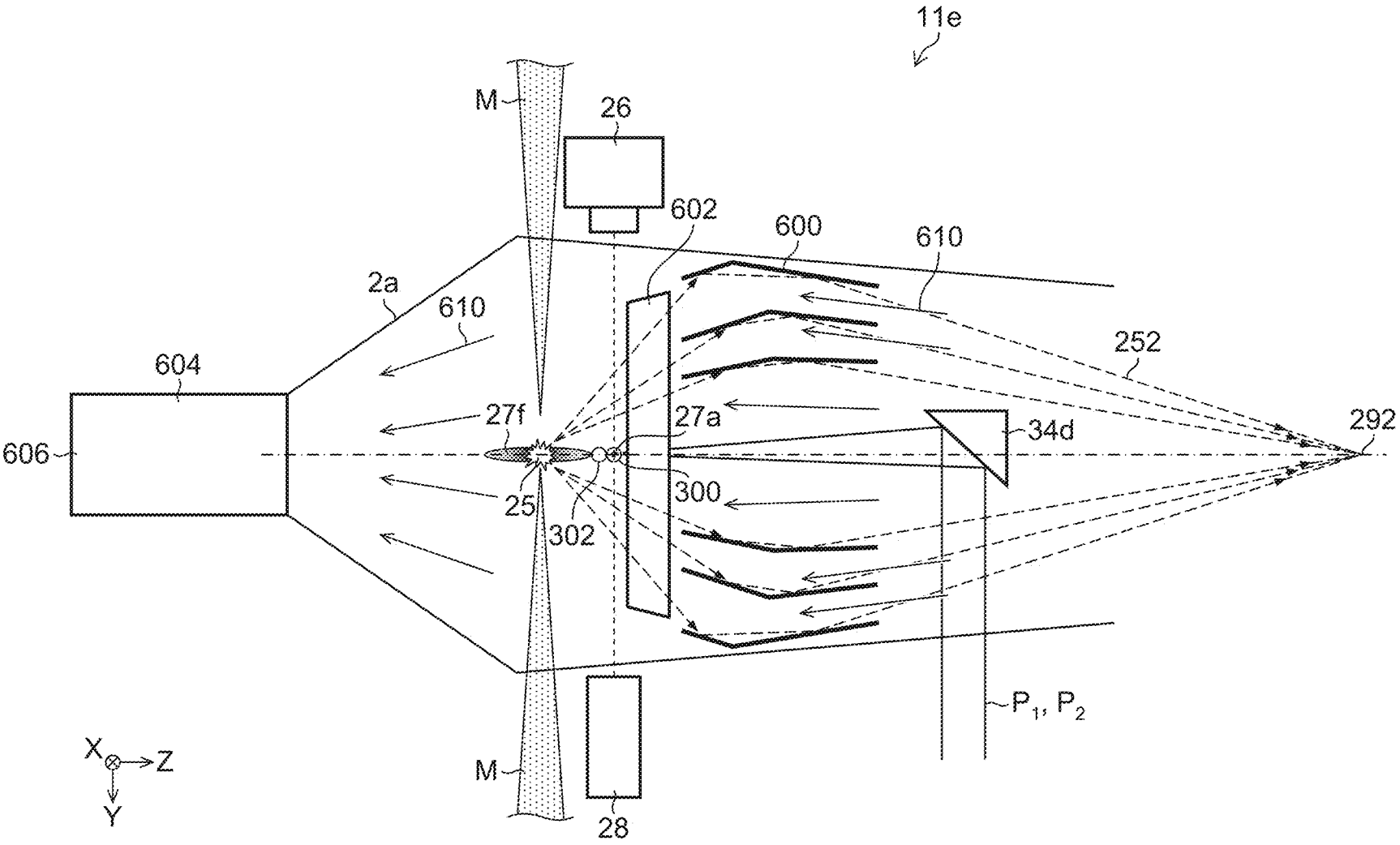
FIG. 14 schematically illustrates a configuration of an EUV light generation system to which an EUV light generation method according to a fourth embodiment is applied.

FIG. 14 is a partial cross-sectional view schematically illustrating a configuration of an EUV light generation system to which an EUV light generation method according to a fourth embodiment is applied. An EUV light generation system 11*e* illustrated in FIG. 14 includes a grazing-incidence collector 600 in place of the EUV light condensing mirror 23 illustrated in FIG. 5 and elsewhere. The grazing-incidence collector 600 may adopt a publicly-known configuration.

The EUV light generation system 11*e* includes a debris trap mechanism 602 and a second debris recovery unit 604. The debris trap mechanism 602 is disposed inside a vessel 2*a*. The debris trap mechanism 602 is disposed between the plasma generation region 25 and the grazing-incidence collector 600 in the travel direction of the fragment jet target 27*f*.

The debris trap mechanism 602 may adopt a publicly-known configuration. The travel direction of the fragment jet target 27*f* in the EUV light generation system 11*e* is a minus Z direction.

The second debris recovery unit 604 is disposed at a position downstream of the plasma generation region 25 in the travel direction of the fragment jet target 27*f*. The second debris recovery unit 604 has a second discharge port 606 provided on a side opposite to the vessel 2*a*.

The EUV light generation system 11*e* has a gas introduction part not illustrated for introducing gas into the vessel 2*a*. The gas flow direction inside the vessel 2*a* is a direction from the intermediate focusing point 292 side toward the second debris recovery unit 604 side. An arrow line denoted by a reference numeral 610 is a gas flow direction inside the vessel 2*a*.

The EUV light generation system 11*e* includes a laser device that outputs the first pre-pulse laser light $P_1$ and the second pre-pulse laser light $P_2$, and a second pre-pulse laser light transmission device 34*d*. The first pre-pulse laser light $P_1$ and the second pre-pulse laser light $P_2$ are made incident from the intermediate focusing point 292 side toward the second debris recovery unit 604 side via the second pre-pulse laser light transmission device 34*d*. The second pre-pulse laser light transmission device 34*d* is disposed inside the vessel 2*a*.

The EUV light generation system 11*e* includes a laser device that outputs the main pulse laser light M in which the propagation direction thereof is a direction orthogonal to the propagation direction of the first pre-pulse laser light $P_1$ and the propagation direction of the second pre-pulse laser light $P_2$. The propagation direction of the main pulse laser light M may intersect the propagation direction of the first pre-pulse laser light $P_1$ and the propagation direction of the second pre-pulse laser light $P_2$ at an angle equal to or smaller than 90°, or an angle larger than 90°.

8.2 Operation

The initial velocity of the fragment jet target 27*f* is acted on part of particles such as debris components after at least part of the fragment jet target 27*f* is made into plasma, as inertia, and the part of particles move toward the second debris recovery unit 604 and are recovered by the second debris recovery unit 604. The other part of the particles of debris components and the like not moving toward the second debris recovery unit 604 is recovered by the debris trap mechanism 602.

A gas flow inside the vessel 2*a* is acted on the part of the particles of debris components and the like not moving toward the second debris recovery unit 604, and the particles flow toward the second debris recovery unit 604. The part of the particles of the debris components and the like flowing toward the second debris recovery unit 604 and not moving toward the debris trap mechanism 602 are recovered by the second debris recovery unit 604. The particles of the debris components and the like recovered by the second debris recovery unit 604 are discharged to the outside of the vessel 2*a* via the second discharge port 606.

A deformed liquid target generation step may include an aspect of irradiating the droplet 27*a* with the first pre-pulse laser light $P_1$ from a side opposite to the first pre-pulse laser light irradiation region 300 over the grazing-incidence collector 600 in the present disclosure.

A fragment jet target generation step may include an aspect of irradiating a deformed liquid target with the second pre-pulse laser light $P_2$ from a side opposite to the second pre-pulse laser light irradiation region 302 over the grazing-incidence collector 600 in the present disclosure.

The third laser light irradiation step may include an aspect of irradiating the fragment jet target 27*f* that reached the plasma generation region 25 downstream of the grazing-incidence collector 600 in the propagation direction of the second pre-pulse laser light $P_2$, with the main pulse laser light M in the present disclosure. A first recovery step may include a step of recovering a debris component by the second debris recovery unit 604 in the present disclosure.

8.3 Effect

The grazing-incidence collector 600 is provided in place of the EUV light condensing mirror 23. Inside the vessel 2*a*, gas is supplied in a flow direction from the side of the intermediate focusing point 292 and the grazing-incidence collector 600 toward the plasma generation region 25 side. Thereby, the travel direction of the fragment jet target 27*f* and the gas flow direction inside the vessel 2*a* are in a direction of separating the debris components from the grazing-incidence collector 600. Thereby, it is possible to suppress a flow of the particles of the debris components and the like toward the grazing-incidence collector 600.

As the second debris recovery unit 604 has the second discharge port 606, a discharge port for discharging particles of the debris components and the like to the outside of the vessel 2*a* and a discharge port for discharging the gas in the vessel 2*a* can be commonly used.

9. Fifth Embodiment 9.1 Configuration

Figure 15:
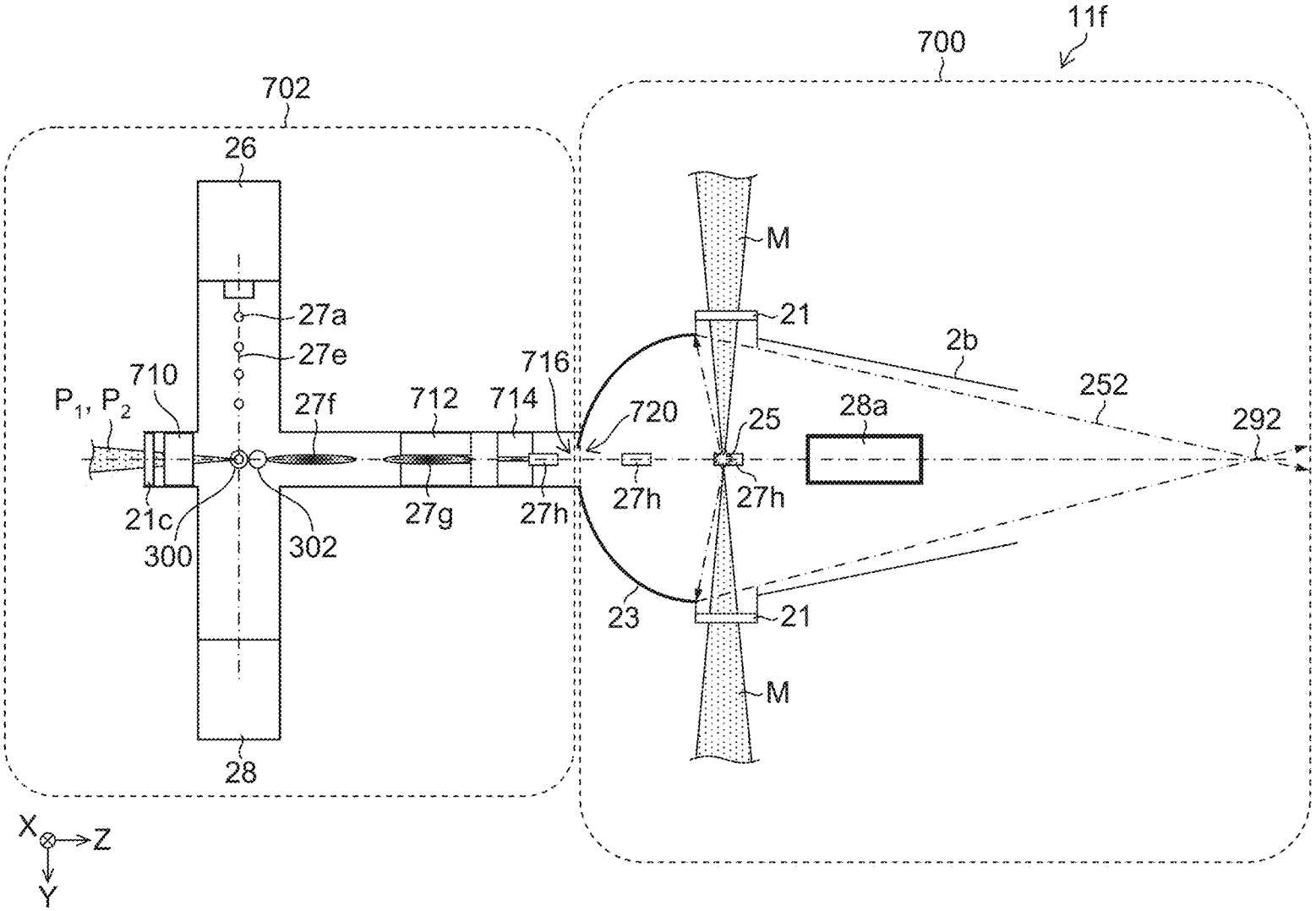
FIG. 15 schematically illustrates a configuration of an EUV light generation system to which an EUV light generation method according to a fifth embodiment is applied.

FIG. 15 is a partial cross-sectional view schematically illustrating a configuration of an EUV light generation system to which an EUV light generation method according to a fifth embodiment is applied. The EUV light generation system 11*f* illustrated in FIG. 15 includes an EUV light generation unit 700 and a fragment jet target generation unit 702.

The fragment jet target generation unit 702 includes a target feeding unit 26, a target recovery unit 28, a window 21*c*, a second debris suppression device 710, a divergence regulation device 712, and a pulse cutout device 714.

The divergence regulation device 712 and the pulse cutout device 714 are disposed at positions downstream of the first pre-pulse laser light irradiation region 300 in the travel direction of the fragment jet target 27*f*. The divergence regulation device 712 and the pulse cutout device 714 are disposed in the order of the divergence regulation device 712 and the pulse cutout device 714 from the upstream side in the travel direction of the fragment jet target 27*f*.

The fragment jet target generation unit 702 includes a target output unit 716. The target output unit 716 outputs a third fragment jet target 27*h* in a pulse state. The third fragment jet target 27*h* is cut out in a predetermined length in the travel direction of the fragment jet target 27*f*. The predetermined length of the fragment jet target 27*f* is shorter than the length at the time when the fragment jet target 27*f* is generated.

The EUV light generation unit 700 includes the vessel 2*b*, the window 21, the EUV light condensing mirror 23, and the second target recovery unit 28*a*. The EUV light generation unit 700 includes a target introduction unit 720 for introducing the third fragment jet target 27*h* output from the fragment jet target generation unit 702.

9.2 Operation

The droplet 27*a* is irradiated with the first pre-pulse laser light $P_1$ and the second pre-pulse laser light $P_2$ in the fragment jet target generation unit 702, whereby the fragment jet target 27*f* is generated. The fragment jet target 27*f* travels along the propagation direction of the first pre-pulse laser light $P_1$ and the propagation direction of the second pre-pulse laser light $P_2$.

The second debris suppression device 710 recovers particles of the debris components and the like moving toward the window 21*c*. The divergence regulation device 712 suppresses dispersion in the direction of the condensing diameter of the fragment jet target 27*f*. A second fragment jet target 27*g* in which dispersion to the direction of the condensing diameter is suppressed travels along the propagation direction of the first pre-pulse laser light $P_1$ and the propagation direction of the second pre-pulse laser light $P_2$.

The pulse cutout device 714 cuts out the fragment jet target 27*f* in a predetermined length in the travel direction of the second fragment jet target 27*g*, and generates a third fragment jet target 27*h* in a pulse state. The third fragment jet target 27*h* is introduced to the EUV light generation unit 700 via the target output unit 716 and the target introduction unit 720.

When the third fragment jet target 27*h* introduced to the EUV light generation unit 700 reaches the plasma generation region 25, the third fragment jet target 27*h* is irradiated with the main pulse laser light M. When the third fragment jet target 27*h* is irradiated with the main pulse laser light M, at least a part of the third fragment jet target 27*h* is made into plasma, and EUV light is radiated from the target substance that was made into plasma.

The divergence regulation device 712 and the pulse cutout device 714 may be omitted, and the fragment jet target 27*f* may be introduced to the EUV light generation unit 700.

The initial velocity of the fragment jet target 27*f* is acted on the debris components generated when the third fragment jet target 27*h* is made into plasma, as inertia, whereby they move toward the second target recovery unit 28*a*. The debris components moving to the second target recovery unit 28*a* are recovered by the second target recovery unit 28*a*. A first recovery step may include a step of recovering particles of the debris components moving toward the second target recovery unit 28*a*.

A deformed liquid target generation step may include an aspect of irradiating the droplet 27*a* that reached the first pre-pulse laser light irradiation region 300 separated from the plasma generation region 25 with the first pre-pulse laser light $P_1$, in the present disclosure.

A fragment jet target generation step may include an aspect of irradiating a deformed liquid target that reached the second pre-pulse laser light irradiation region 302 separated from the plasma generation region 25 with the second pre-pulse laser light $P_2$, in the present disclosure.

A divergence regulation step corresponds to a step of generating the second fragment jet target 27*g* in which dispersion in the direction of the condensing diameter of the fragment jet target 27*f* by the divergence regulation device 712 is suppressed, in the present disclosure.

A cutout step corresponds to a step of cutting out the second fragment jet target 27*g* in a predetermined length and generating the third fragment jet target 27*h* by the pulse cutout device 714, in the present disclosure.

9.3 Effect

The EUV light generation unit 700 and the fragment jet target generation unit 702 are separated spatially. Thereby, it is possible to suppress contamination on the EUV light condensing mirror 23 due to the droplet 27*a*, particles rebounded from the target recovery unit 28, and debris components generated when the fragment jet target 27*f* is generated.

The distance from the target feeding unit 26 to the first pre-pulse laser light irradiation region 300 is reduced, and the positional stability of the droplet 27*a* in the first pre-pulse laser light irradiation region 300 can be improved.

Dispersion in the diameter direction of the fragment jet target 27*f* can be suppressed with the divergence regulation device 712. The length of the fragment jet target 27*f* in the travel direction of the fragment jet target 27*f* can be regulated with the pulse cutout device 714. Thereby, it is possible to suppress entering of a target component, not contributing to radiation of EUV light, into the plasma generation region 25, and to suppress generation of debris components after at least a part of the fragment jet target 27*f* is made into plasma.

The description provided above is intended to provide just examples without any limitations. Accordingly, it will be obvious to those skilled in the art that changes can be made to the embodiments of the present disclosure without departing from the scope of the accompanying claims.

The terms used in the present description and in the entire scope of the accompanying claims should be construed as terms "without limitations". For example, a term "including" or "included" should be construed as "not limited to that described to be included". A term "have" should be construed as "not limited to that described to be held". Moreover, an indefinite article "a/an" described in the present description and in the accompanying claims should be construed to mean "at least one" or "one or more".

What is claimed is:

1. An extreme ultraviolet light generation method comprising:

a droplet output step of outputting a droplet to a first laser light irradiation region that is a region different from a plasma generation region;

a deformed liquid target generation step of irradiating the droplet with first laser light having a pulse width of 1.0 nanosecond or longer to generate a deformed liquid target, the droplet being output in the droplet output step and reaching the first laser light irradiation region;

a fragment jet target generation step of irradiating the deformed liquid target with second laser light having a pulse width of 100 femtoseconds or longer but shorter than 50 picoseconds, in which a delay period from the first laser light is 0.4 microseconds or longer but 1.2 microseconds or shorter, to generate a fragment jet target, the deformed liquid target being generated in the deformed liquid target generation step and reaching a second laser light irradiation region that is a region different from the plasma generation region; and a third laser light irradiation step of irradiating at least a part of the fragment jet target with third laser light that propagates in a direction intersecting a propagation direction of the second laser light, the fragment jet target being generated in the fragment jet target generation step and reaching the plasma generation region.

2. The extreme ultraviolet light generation method according to claim 1, wherein in the third laser light irradiation step, the fragment jet target that reaches the plasma generation region is irradiated with the third laser light, after ions generated in at least one of the deformed liquid target generation step and the fragment j et target generation step are dispersed.

3. The extreme ultraviolet light generation method according to claim 1, wherein in the third laser light irradiation step, the fragment jet target is irradiated with the third laser light that propagates in a direction orthogonal to a travel direction of the fragment jet target.

4. The extreme ultraviolet light generation method according to claim 1, wherein in the fragment jet target generation step, the deformed liquid target is irradiated with the second laser light that propagates in a direction identical to a propagation direction of the first laser light.

5. The extreme ultraviolet light generation method according to claim 1, wherein in the fragment jet target generation step, the deformed liquid target that reaches the second laser light irradiation region is irradiated with the second laser light, at least a part of the second laser light irradiation region overlapping the first laser light irradiation region.

6. The extreme ultraviolet light generation method according to claim 1, further comprising a first recover step of recovering a particle moving toward a downstream side of the plasma generation region in the propagation direction of the second laser light.

7. The extreme ultraviolet light generation method according to claim 1, wherein in the third laser light irradiation step, the fragment jet target generated by being irradiated with the second laser light once is irradiated with a plurality of beams of the third laser light with an interval period corresponding to a traveling velocity of the fragment jet target, such that a density of a target substance in the fragment j et target becomes a density suitable for generation of extreme ultraviolet light or higher.

8. The extreme ultraviolet light generation method according to claim 1, further comprising a magnetic field generation step of generating a magnetic field having a magnetic field axis in a direction parallel to the propagation direction of the second laser light in the plasma generation region.

9. The extreme ultraviolet light generation method according to claim 1, further comprising a second recovery step of recovering a particle moving toward at least one of a first introduction window for introducing the first laser light and a second introduction window for introducing the second laser light.

10. The extreme ultraviolet light generation method according to claim 1, wherein in the third laser light irradiation step, the fragment jet target is irradiated with a plurality of beams of the third laser light that propagate in directions intersecting each other in the plasma generation region.

11. The extreme ultraviolet light generation method according to claim 1, wherein in the deformed liquid target generation step, the first laser light is radiated from a side opposite to the first laser light irradiation region over a grazing-incidence collector in a propagation direction of the first laser light, in the fragment jet target generation step, the second laser light is radiated from a side opposite to the second laser light irradiation region over the grazing-incidence collector in the propagation direction of the second laser light, and in the third laser light irradiation step, at least a part of the fragment jet target that reaches the plasma generation region on a downstream side of the grazing-incidence collector in the propagation direction of the second laser light is irradiated with the third laser light.

12. The extreme ultraviolet light generation method according to claim 1, wherein in the deformed liquid target generation step, the droplet that reaches the first laser light irradiation region separated from the plasma generation region is irradiated with the first laser light, and in the fragment jet target generation step, the deformed liquid target that reaches the second laser light irradiation region separated from the plasma generation region is irradiated with the second laser light.

13. The extreme ultraviolet light generation method according to claim 12, further comprising a divergence regulation step of generating a second fragment jet target in which dispersion in a diameter direction of the fragment jet target generated in the fragment jet target generation step is suppressed.

14. The extreme ultraviolet light generation method according to claim 12, further comprising a cutout step of generating a third fragment jet target in which a length of the fragment jet target generated in the fragment jet target generation step in a travel direction of the fragment jet target is cut to have a length shorter than a length at the time of generation thereof.

15. The extreme ultraviolet light generation method according to claim 1, wherein in the droplet output step, a droplet having a diameter of 25 micrometers or larger but 30 micrometers or smaller is output.

16. The extreme ultraviolet light generation method according to claim 1, wherein in the deformed liquid target generation step, the droplet is irradiated with the first laser light in which fluence is 17.0 joules per square centimeter or larger but 52.0 joules per square centimeter or smaller.

17. The extreme ultraviolet light generation method according to claim 1, wherein in the fragment jet target generation step, the deformed liquid target is irradiated with the second laser light in which fluence is 0.5 joules per square centimeter or larger but 6.2 joules per square centimeter or smaller.

18. The extreme ultraviolet light generation method according to claim 1, wherein in the fragment jet target generation step, the deformed liquid target is irradiated with the second laser light having a pulse width of 14.0 picoseconds.

* * * * *